US009441631B2

(12) United States Patent
Roof

(10) Patent No.: US 9,441,631 B2
(45) Date of Patent: Sep. 13, 2016

(54) SUCTION DUCT WITH HEAT-STAKED SCREEN

(75) Inventor: Johnathan P. Roof, Camillus, NY (US)

(73) Assignee: Bitzer Kuehlmaschinenbau GmbH (DE)

( * ) Notice: Subject to any disclaimer, the term of this patent is extended or adjusted under 35 U.S.C. 154(b) by 519 days.

(21) Appl. No.: 13/428,026

(22) Filed: Mar. 23, 2012

(65) Prior Publication Data

US 2013/0248022 A1 Sep. 26, 2013

(51) Int. Cl.

| | |
|---|---|
| ***F03C 4/00*** | (2006.01) |
| ***F04C 25/00*** | (2006.01) |
| ***F04C 23/00*** | (2006.01) |
| ***F04C 29/12*** | (2006.01) |
| ***F04C 18/02*** | (2006.01) |
| ***F04C 29/00*** | (2006.01) |
| *F04C 28/28* | (2006.01) |

(52) U.S. Cl.

CPC ..... *F04C 25/00* (2013.01); *F04C 18/0215* (2013.01); *F04C 23/008* (2013.01); *F04C 29/0092* (2013.01); *F04C 29/12* (2013.01); *F04C 28/28* (2013.01); *F04C 2230/231* (2013.01); *F04C 2240/30* (2013.01); *F04C 2240/80* (2013.01); *F04C 2240/806* (2013.01); *Y10T 29/49826* (2015.01); *Y10T 137/794* (2015.04)

(58) Field of Classification Search

CPC ..... F04C 18/0215; F04C 13/005; F04C 29/0092; B01D 46/0024; B01D 46/2411; F04B 39/16; F25B 43/003

USPC ..... 418/55.1, 55.4, 55.6, 88; 210/321.72, 210/321.75, 321.84, 416.1

See application file for complete search history.

(56) References Cited

U.S. PATENT DOCUMENTS

| | | | | |
|---|---|---|---|---|
| 35,216 | A | | 5/1862 | Carton |
| 4,606,706 | A | | 8/1986 | Utter |
| 4,886,435 | A | | 12/1989 | Sawai et al. |
| 4,892,469 | A | * | 1/1990 | McCullough et al. ..... 418/55.6 |
| 5,342,185 | A | | 8/1994 | Anderson |
| 5,407,335 | A | | 4/1995 | Caillat et al. |
| 5,427,511 | A | | 6/1995 | Caillat et al. |
| 5,482,450 | A | | 1/1996 | Caillat et al. |

(Continued)

FOREIGN PATENT DOCUMENTS

| | | |
|---|---|---|
| GB | 762906 A | 12/1956 |
| JP | 02045684 | 2/1990 |

(Continued)

OTHER PUBLICATIONS

U.S. Appl. No. 13/427,984, filed Mar. 23, 2012, Cullen et al.

(Continued)

*Primary Examiner* — Thomas Denion
*Assistant Examiner* — Thomas Olszewski
(74) *Attorney, Agent, or Firm* — Reinhart Boerner Van Deuren P.C.

(57) ABSTRACT

A suction duct for a compressor such as a scroll compressor may include a plastic ring body with a metal screen heat staked in a window of the ring body to filter refrigerant gas entering the motor cavity. the ring body may be in surrounding relation of the motor and resiliently compressed in the housing through intermittent contact with the inner housing surface to better seal around the inlet port. Oil drain channels and stabilizing ribs may be along the outside surface of the ring body.

15 Claims, 18 Drawing Sheets

(56) References Cited

U.S. PATENT DOCUMENTS

| | | | | |
|---|---|---|---|---|
| 5,580,230 | A | 12/1996 | Keifer et al. | |
| 5,897,306 | A | 4/1999 | Beck | |
| 6,116,877 | A * | 9/2000 | Takeuchi et al. | 418/88 |
| 6,254,354 | B1 | 7/2001 | Sonnier, Jr. et al. | |
| 6,293,767 | B1 | 9/2001 | Bass | |
| 6,398,530 | B1 | 6/2002 | Hasemann | |
| 6,560,868 | B2 | 5/2003 | Milliff et al. | |
| 6,572,352 | B2 | 6/2003 | Reinhart | |
| 6,616,429 | B1 | 9/2003 | Weber et al. | |
| 6,648,616 | B2 | 11/2003 | Patel et al. | |
| 6,761,541 | B1 | 7/2004 | Clendenin | |
| 6,814,551 | B2 | 11/2004 | Kammhoff et al. | |
| 6,960,070 | B2 | 11/2005 | Kammhoff et al. | |
| 7,070,401 | B2 | 7/2006 | Clendenin et al. | |
| 7,112,046 | B2 | 9/2006 | Kammhoff et al. | |
| 7,168,931 | B2 | 1/2007 | Ginies | |
| 7,470,179 | B1 * | 12/2008 | Ritter et al. | 454/354 |
| 7,686,859 | B2 * | 3/2010 | Barratt | 55/423 |
| 7,819,638 | B2 | 10/2010 | Grimm et al. | |
| 7,878,775 | B2 | 2/2011 | Duppert et al. | |
| 8,002,528 | B2 | 8/2011 | Hodapp et al. | |
| 8,133,043 | B2 | 3/2012 | Duppert | |
| 8,152,500 | B2 | 4/2012 | Beagle et al. | |
| 8,167,595 | B2 * | 5/2012 | Duppert | 418/55.6 |
| 2006/0196219 | A1 * | 9/2006 | McGregor et al. | 62/470 |
| 2009/0035168 | A1 | 2/2009 | Ginies et al. | |
| 2009/0252624 | A1 | 10/2009 | Genevois et al. | |

FOREIGN PATENT DOCUMENTS

| | | | |
|---|---|---|---|
| JP | 05010281 | A | 1/1993 |
| JP | 2005330895 | A | 12/2005 |
| JP | 2010036198 | | 2/2010 |
| KR | 20110076975 | A | 7/2011 |

OTHER PUBLICATIONS

U.S. Appl. No. 13/427,991, filed Mar. 23, 2012, Rogalski.
U.S. Appl. No. 13/427,992, filed Mar. 23, 2012, Bessel et al.
U.S. Appl. No. 13/428,036, filed Mar. 23, 2012, Bush et al.
U.S. Appl. No. 13/428,165, filed Mar. 23, 2012, Heusler.
U.S. Appl. No. 13/428,172, filed Mar. 23, 2012, Roof et al.
U.S. Appl. No. 13/428,173, filed Mar. 23, 2012, Bush.
U.S. Appl. No. 13/428,042, filed Mar. 23, 2012, Roof et al.
U.S. Appl. No. 13/428,072, filed Mar. 23, 2012, Wang et al.
U.S. Appl. No. 13/428,337, filed Mar. 23, 2012, Duppert et al.
U.S. Appl. No. 13/428,406, filed Mar. 23, 2012, Duppert.
U.S. Appl. No. 13/429,407, filed Mar. 23, 2012, Duppert et al.
U.S. Appl. No. 13/428,505, filed Mar. 23, 2012, Duppert et al.

* cited by examiner

SUCTION DUCT WITH HEAT-STAKED SCREEN

FIELD OF THE INVENTION

The present invention generally relates to compressors for compressing refrigerant and more particularly to an apparatus for filtering fluid prior to entering a compressor assembly with some embodiments pertaining to scroll compressors.

BACKGROUND OF THE INVENTION

A scroll compressor is a certain type of compressor that is used to compress refrigerant for such applications as refrigeration, air conditioning, industrial cooling and freezer applications, and/or other applications where compressed fluid may be used. Such prior scroll compressors are known, for example, as exemplified in U.S. Pat. Nos. 6,398,530 to Hasemann; 6,814,551, to Kammhoff et al.; 6,960,070 to Kammhoff et al.; and 7,112,046 to Kammhoff et al., all of which are assigned to a Bitzer entity closely related to the present assignee. As the present disclosure pertains to improvements that can be implemented in these or other scroll compressor designs, the entire disclosures of U.S. Pat. Nos. 6,398,530; 7,112,046; 6,814,551; and 6,960,070 are hereby incorporated by reference in their entireties.

As is exemplified by these patents, scroll compressors assemblies conventionally include an outer housing having a scroll compressor contained therein. A scroll compressor includes first and second scroll compressor members. A first compressor member is typically arranged stationary and fixed in the outer housing. A second scroll compressor member is movable relative to the first scroll compressor member in order to compress refrigerant between respective scroll ribs which rise above the respective bases and engage in one another. Conventionally the movable scroll compressor member is driven about an orbital path about a central axis for the purposes of compressing refrigerant. An appropriate drive unit, typically an electric motor, is provided usually within the same housing to drive the movable scroll member.

In some scroll compressors, it is known to have axial restraint, whereby the fixed scroll member has a limited range of movement. This can be desirable due to thermal expansion when the temperature of the orbiting scroll and fixed scroll increases causing these components to expand. Examples of an apparatus to control such restraint are shown in U.S. Pat. No. 5,407,335, issued to Caillat et al., the entire disclosure of which is hereby incorporated by reference.

The present invention is directed towards improvements over the state of the art as it relates to the refrigerant flow, filtering, and other features of scroll compressors.

BRIEF SUMMARY OF THE INVENTION

The present invention includes an aspect of internally bonding a screen to a suction duct that may be employed in a compressor. In one aspect, embodiments of the invention provide a compressor for compressing a fluid including a housing having an inlet for receiving the fluid and an outlet returning the fluid. The compressor is preferably a scroll compressor, but could be another compressor such as valve, piston, screw etc. A compressor mechanism adapted to compress a fluid toward the outlet, with the compressor mechanism housed in the housing. A drive unit operatively connected to the compressor mechanism for driving the compression mechanism to compress fluid. A suction duct in the housing having an inlet region arranged over the inlet of the housing. A screen in the inlet region is integrally bonded to the suction duct.

In a particular aspect, the drive unit is an electrical motor and the suction duct comprises a window and a recessed ledge generally formed from a plastic material. The recessed ledge surrounds the window and generally faces the inlet and away from the electrical motor, and the screen is situated in the recessed window.

In another aspect, the screen may be a metal screen. The inlet region of the suction duct covers the stator, and the metal screen is electrically isolated from the stator by the plastic material of the window and recessed ledge.

In a particular aspect, the suction duct comprises a ring body that surrounds the electrical motor. The housing includes a generally cylindrical shell surrounding the ring body. The ring body has an arcuate surface surrounding the window and the recessed ledge. The arcuate surface is adapted to be in surface to surface contact with an inner surface of the generally cylindrical shell such that a flow path for fluid extends through the screen and into a region about the motor.

In another aspect, the suction duct may comprise of plastic material being a unitary plastic molded component part. At least a portion of the plastic material is thermally deformed to integrally bond the screen to the suction duct.

In another aspect, the suction duct may include a ring body having a window and a recessed ledge and providing a pocket in the ring body. The recessed ledge surrounds the window, and the screen is situated along the recessed ledge.

In some embodiments, the screen may be heat staked to the suction duct. The suction duct comprises a plurality of bosses that extend and thermally deform to integrally bond to the screen.

In other embodiments, portions of the ring body surrounding the window are thermally deformed over the screen and recessed ledge.

In yet other embodiments, the compressor may include a slot projecting axially through an end of the ring body and connecting to the window. The slot is adapted to receive the screen therethrough to facilitate positioning of the screen in the pocket. The slot also includes an overhang formed into the ring body over the recessed ledge. At least a portion of the overhang is thermally welded to secure the screen to the ring body.

In a particular implementation, the compressor mechanism is a scroll compressor comprising scroll compressor bodies having respective bases and respective scroll ribs that project from the respective bases and which mutually engage about an axis for compressing fluid. A motor facilitates relative orbiting between the scroll compressor bodies. The screen of the suction duct is secured by integrally bonding with enough retention force to counter the force of refrigerant flow through the inlet and through the suction duct and screen and eventually toward the scroll compressor bodies.

In certain aspects, the suction duct may be seated on a peripheral groove of a lower bearing member.

Another aspect of the invention is directed toward manufacturing and assembly features. A method of securing a screen to a suction duct for use in a compressor may include providing a suction duct body having a window and a recessed ledge. The recessed ledge surrounds the window. The method further includes situating a screen in the window and along the recessed ledge, and finally thermally welding material of the suction duct body to the screen.

In certain aspects, the suction duct body is composed of plastic material, and thermally welding may comprise melting material of the suction duct body.

In a particular aspect, the screen is metal and electrically isolated from a motor of the compressor. The motor may be in contact with the plastic material of the suction duct body.

In certain aspects, the compressor is a scroll compressor that has a housing with an inlet, and the suction duct body comprises a ring shape that includes arranging the screen in a region over the inlet with the inlet flow flowing through the suction duct body and toward the motor. Further, the motor may be surrounded by the suction duct body.

In certain embodiments, the method may include heat staking a plurality of bosses formed on the suction duct to thermally weld material of the suction duct body to the screen.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

Figure 1:
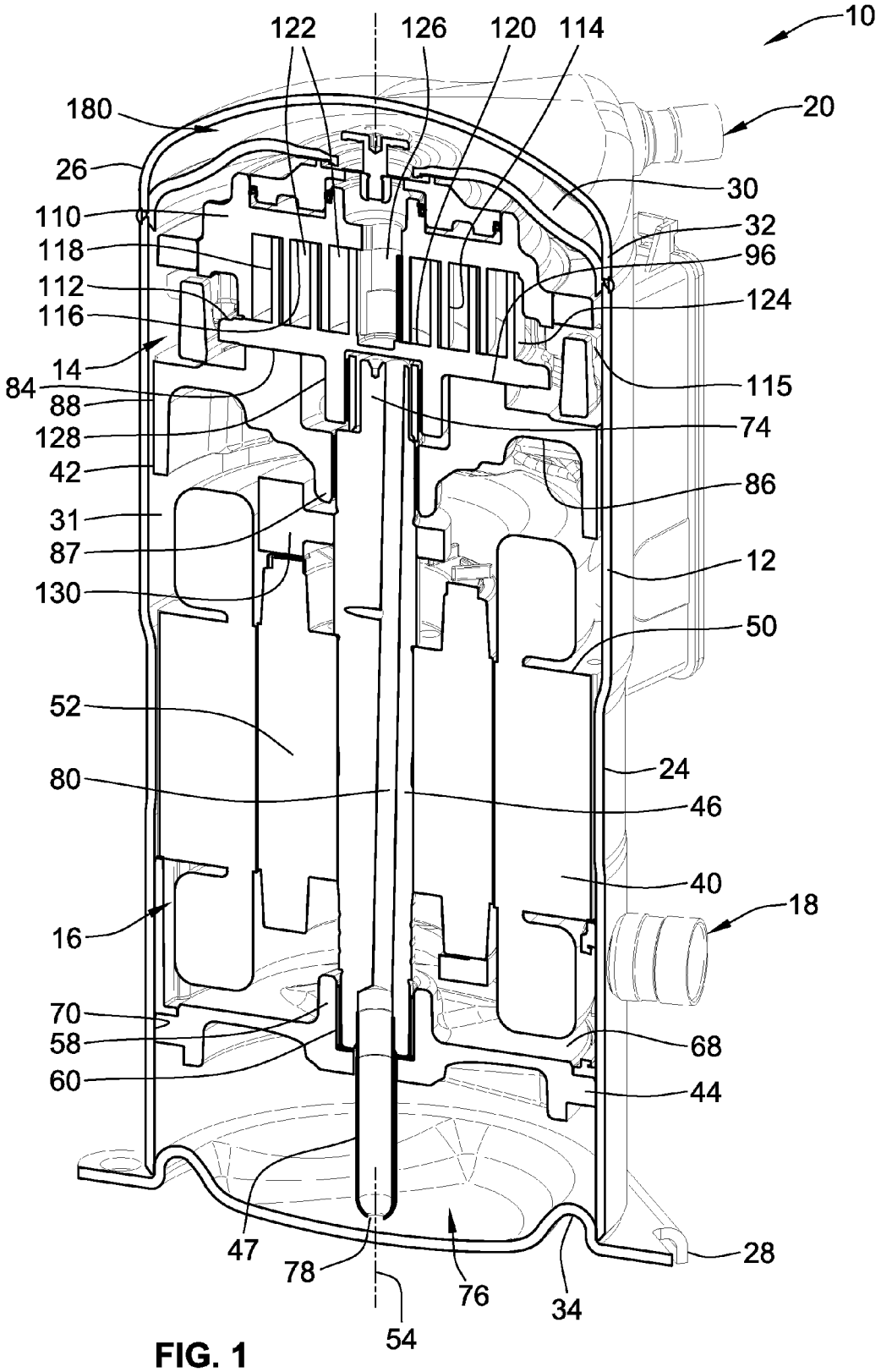
FIG. 1 is a cross-sectional isometric view of a scroll compressor assembly, according to an embodiment of the invention.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

An embodiment of the present invention is illustrated in the figures as a scroll compressor assembly 10 generally including an outer housing 12 in which a scroll compressor 14 can be driven by a drive unit 16. The scroll compressor assembly 10 may be arranged in a refrigerant circuit for refrigeration, industrial cooling, freezing, air conditioning or other appropriate applications where compressed fluid is desired. Appropriate connection ports provide for connection to a refrigeration circuit and include a refrigerant inlet port 18 and a refrigerant outlet port 20 extending through the outer housing 12. The scroll compressor assembly 10 is operable through operation of the drive unit 16 to operate the scroll compressor 14 and thereby compress an appropriate refrigerant or other fluid that enters the refrigerant inlet port 18 and exits the refrigerant outlet port 20 in a compressed high-pressure state.

The outer housing for the scroll compressor assembly 10 may take many forms. In particular embodiments of the invention, the outer housing 12 includes multiple shell sections. In the embodiment of FIG. 1, the outer housing 12 includes a central cylindrical housing section 24, and a top end housing section 26, and a single-piece bottom shell 28 that serves as a mounting base. In certain embodiments, the housing sections 24, 26, 28 are formed of appropriate sheet steel and welded together to make a permanent outer housing 12 enclosure. However, if disassembly of the housing is desired, other housing assembly provisions can be made that can include metal castings or machined components, wherein the housing sections 24, 26, 28 are attached using fasteners.

As can be seen in the embodiment of FIG. 1, the central housing section 24 is cylindrical, joined with the top end housing section 26. In this embodiment, a separator plate 30 is disposed in the top end housing section 26. During assembly, these components can be assembled such that when the top end housing section 26 is joined to the central cylindrical housing section 24, a single weld around the circumference of the outer housing 12 joins the top end housing section 26, the separator plate 30, and the central cylindrical housing section 24. In particular embodiments, the central cylindrical housing section 24 is welded to the single-piece bottom shell 28, though, as stated above, alternate embodiments would include other methods of joining (e.g., fasteners) these sections of the outer housing 12. Assembly of the outer housing 12 results in the formation of an enclosed chamber 31 that surrounds the drive unit 16, and partially surrounds the scroll compressor 14. In particular embodiments, the top end housing section 26 is generally dome-shaped and includes a respective cylindrical side wall region 32 that abuts the top of the central cylindrical housing section 24, and provides for closing off the top end of the outer housing 12. As can also be seen from FIG. 1, the bottom of the central cylindrical housing section 24 abuts a flat portion just to the outside of a raised annular rib 34 of the bottom end housing section 28. In at least one embodiment of the invention, the central cylindrical housing section 24 and bottom end housing section 28 are joined by an exterior weld around the circumference of a bottom end of the outer housing 12.

In a particular embodiment, the drive unit 16 is in the form of an electrical motor assembly 40. The electrical motor assembly 40 operably rotates and drives a shaft 46. Further, the electrical motor assembly 40 generally includes a stator 50 comprising electrical coils and a rotor 52 that is coupled to the drive shaft 46 for rotation together. The stator 50 is supported by the outer housing 12, either directly or via an adapter. The stator 50 may be press-fit directly into outer housing 12, or may be fitted with an adapter (not shown) and press-fit into the outer housing 12. In a particular embodiment, the rotor 52 is mounted on the drive shaft 46, which is supported by upper and lower bearings 42, 44. Energizing the stator 50 is operative to rotatably drive the rotor 52 and thereby rotate the drive shaft 46 about a central axis 54. Applicant notes that when the terms "axial" and "radial" are used herein to describe features of components or assemblies, they are defined with respect to the central axis 54. Specifically, the term "axial" or "axially-extending" refers to a feature that projects or extends in a direction parallel to the central axis 54, while the terms "radial" or "radially-extending" indicates a feature that projects or extends in a direction perpendicular to the central axis 54.

With reference to FIG. 1, the lower bearing member 44 includes a central, generally cylindrical hub 58 that includes a central bushing and opening to provide a cylindrical bearing 60 to which the drive shaft 46 is journaled for rotational support. A plate-like ledge region 68 of the lower bearing member 44 projects radially outward from the central hub 58, and serves to separate a lower portion of the stator 50 from an oil lubricant sump 76. An axially-extending perimeter surface 70 of the lower bearing member 44 may engage with the inner diameter surface of the central housing section 24 to centrally locate the lower bearing member 44 and thereby maintain its position relative to the central axis 54. This can be by way of an interference and press-fit support arrangement between the lower bearing member 44 and the outer housing 12.

In the embodiment of FIG. 1, the drive shaft 46 has an impeller tube 47 attached at the bottom end of the drive shaft 46. In a particular embodiment, the impeller tube 47 is of a smaller diameter than the drive shaft 46, and is aligned concentrically with the central axis 54. As can be seen from FIG. 1, the drive shaft 46 and impeller tube 47 pass through an opening in the cylindrical hub 58 of the lower bearing member 44. At its upper end, the drive shaft 46 is journaled for rotation within the upper bearing member 42. Upper bearing member 42 may also be referred to as a "crankcase".

The drive shaft 46 further includes an offset eccentric drive section 74 that has a cylindrical drive surface 75 (shown in FIG. 2) about an offset axis that is offset relative to the central axis 54. This offset drive section 74 is journaled within a cavity of a movable scroll compressor body 112 of the scroll compressor 14 to drive the movable scroll compressor body 112 about an orbital path when the drive shaft 46 rotates about the central axis 54. To provide for lubrication of all of the various bearing surfaces, the outer housing 12 provides the oil lubricant sump 76 at the bottom end of the outer housing 12 in which suitable oil lubricant is provided. The impeller tube 47 has an oil lubricant passage and inlet port 78 formed at the end of the impeller tube 47. Together, the impeller tube 47 and inlet port 78 act as an oil pump when the drive shaft 46 is rotated, and thereby pumps oil out of the lubricant sump 76 into an internal lubricant passageway 80 defined within the drive shaft 46. During rotation of the drive shaft 46, centrifugal force acts to drive lubricant oil up through the lubricant passageway 80 against the action of gravity. The lubricant passageway 80 has various radial passages projecting therefrom to feed oil through centrifugal force to appropriate bearing surfaces and thereby lubricate sliding surfaces as may be desired.

Figure 2:
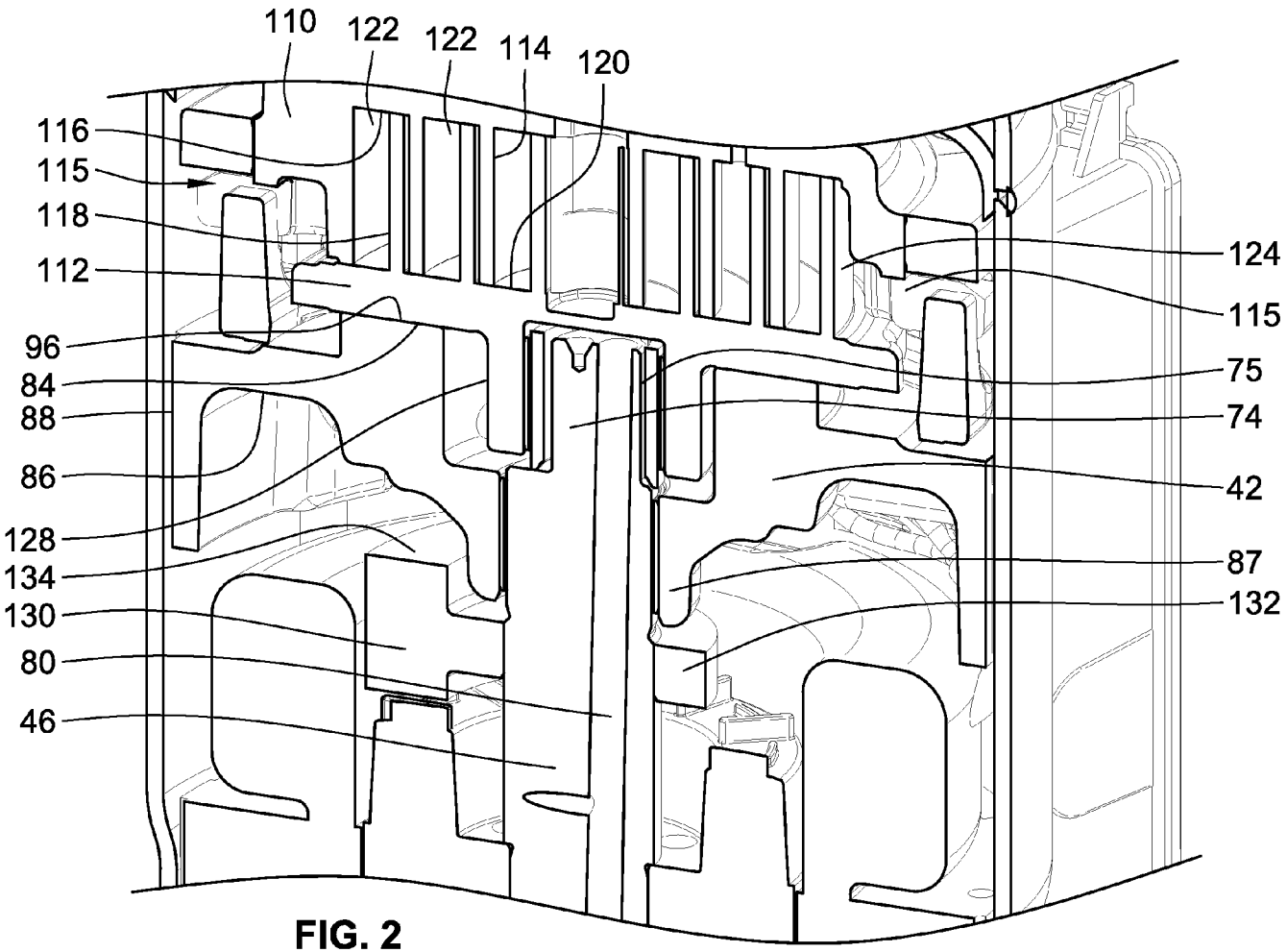
FIG. 2 is a cross-sectional isometric view of an upper portion of the scroll compressor assembly of FIG. 1.
Figure 3:
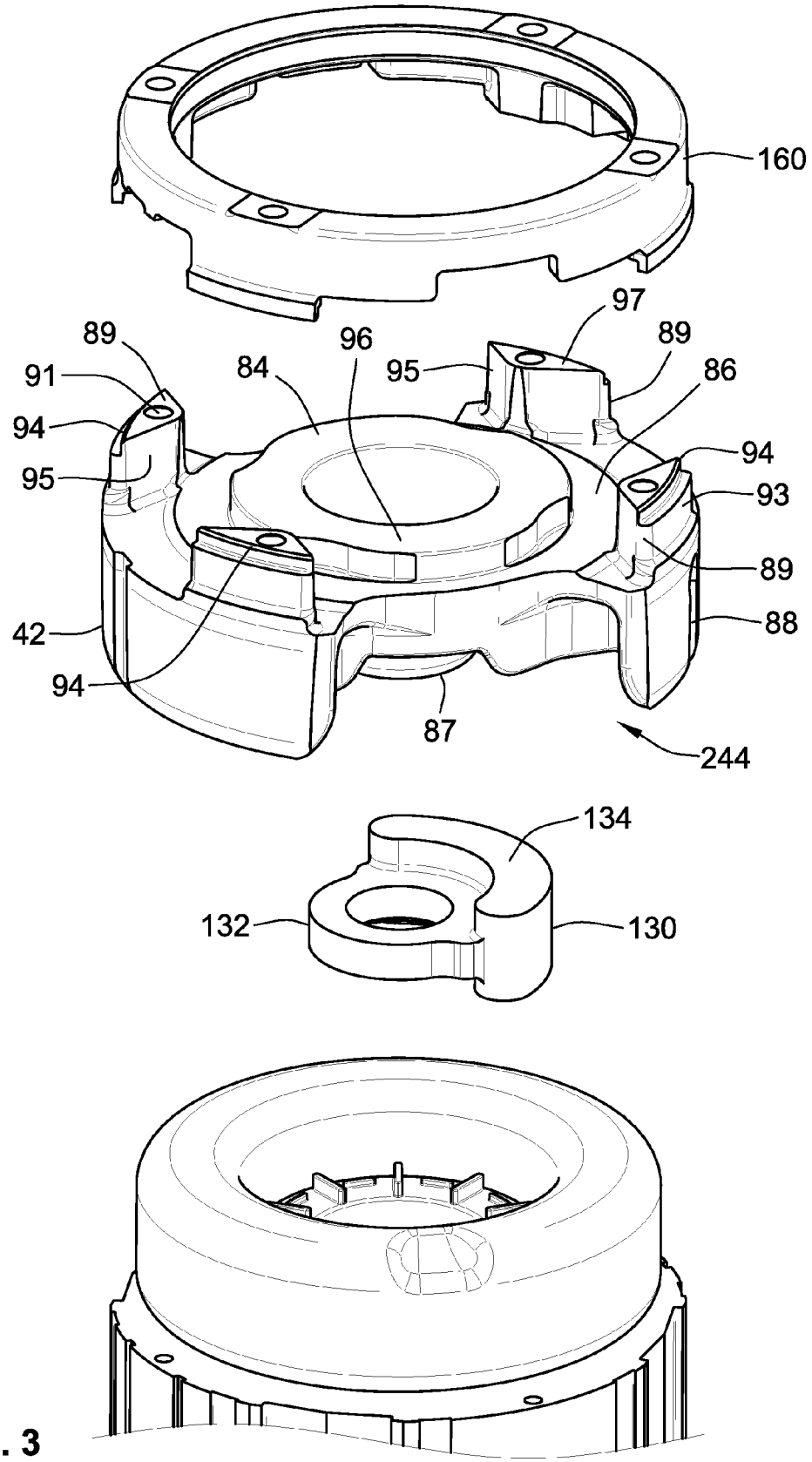
FIG. 3 is an exploded isometric view of selected components of the scroll compressor assembly of FIG. 1.

As shown in FIGS. 2 and 3, the upper bearing member, or crankcase, 42 includes a central bearing hub 87 into which the drive shaft 46 is journaled for rotation, and a thrust bearing 84 that supports the movable scroll compressor body 112. (See also FIG. 9). Extending outward from the central bearing hub 87 is a disk-like portion 86 that terminates in an intermittent perimeter support surface 88 defined by discretely spaced posts 89. In the embodiment of FIG. 3, the central bearing hub 87 extends below the disk-like portion 86, while the thrust bearing 84 extends above the disk-like portion 86. In certain embodiments, the intermittent perimeter support surface 88 is adapted to have an interference and press-fit with the outer housing 12. In the embodiment of FIG. 3, the crankcase 42 includes four posts 89, each post having an opening 91 configured to receive a threaded fastener. It is understood that alternate embodiments of the invention may include a crankcase with more or less than four posts, or the posts may be separate components altogether. Alternate embodiments of the invention also include those in which the posts are integral with the pilot ring 160 instead of the crankcase.

In certain embodiments such as the one shown in FIG. 3, each post 89 has an arcuate outer surface 93 spaced radially inward from the inner surface of the outer housing 12, angled interior surfaces 95, and a generally flat top surface 97 which can support a pilot ring 160. In this embodiment, intermittent perimeter support surface 88 abuts the inner surface of the outer housing 12. Further, each post 89 has a chamfered edge 94 on a top, outer portion of the post 89. In particular embodiments, the crankcase 42 includes a plurality of spaces 244 between adjacent posts 89. In the embodiment shown, these spaces 244 are generally concave and the portion of the crankcase 42 bounded by these spaces 244 will not contact the inner surface of the outer housing 12.

Figure 13:
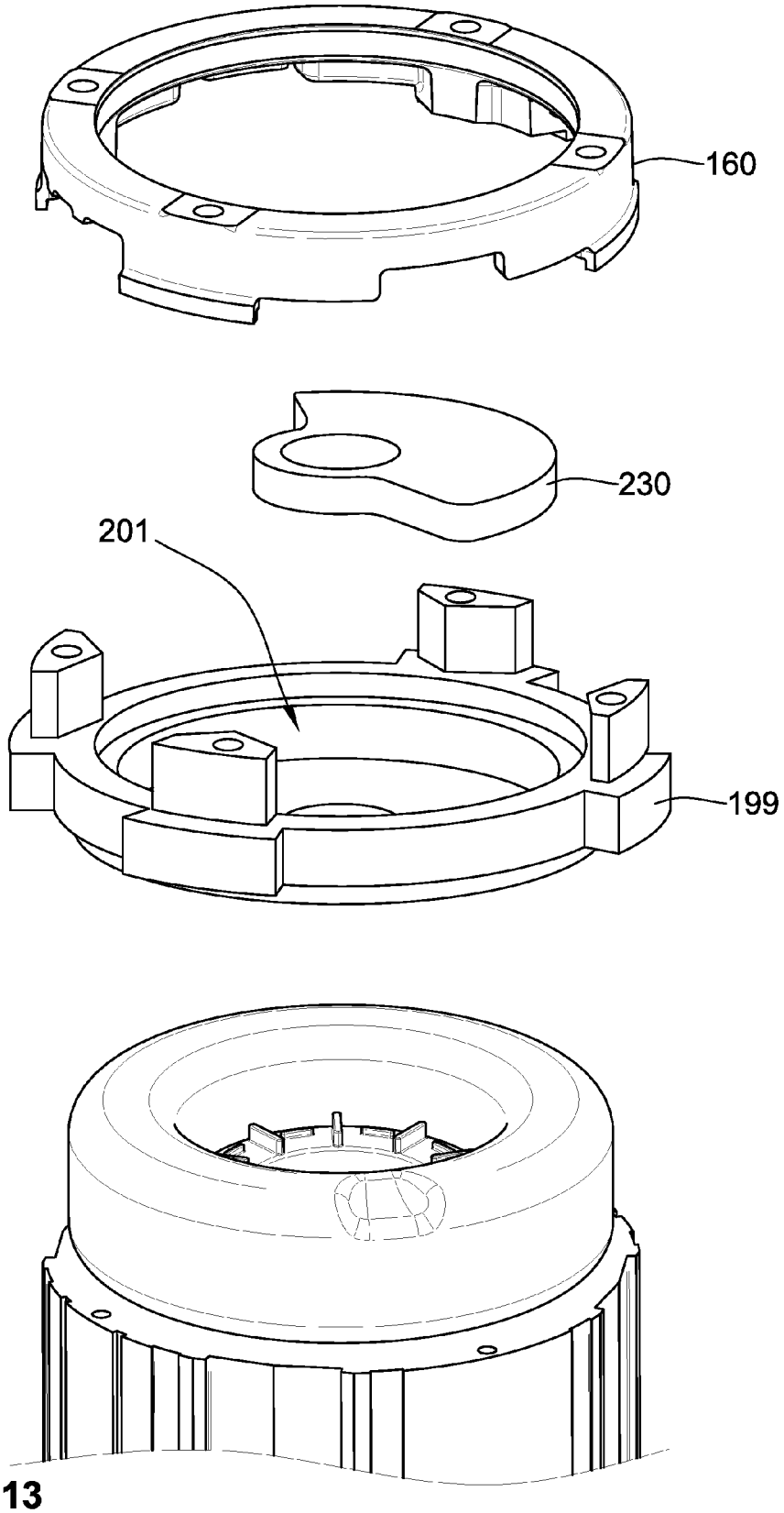
FIG. 13 is an exploded isometric view of selected components for an alternate embodiment of the scroll compressor assembly.
Figure 14:
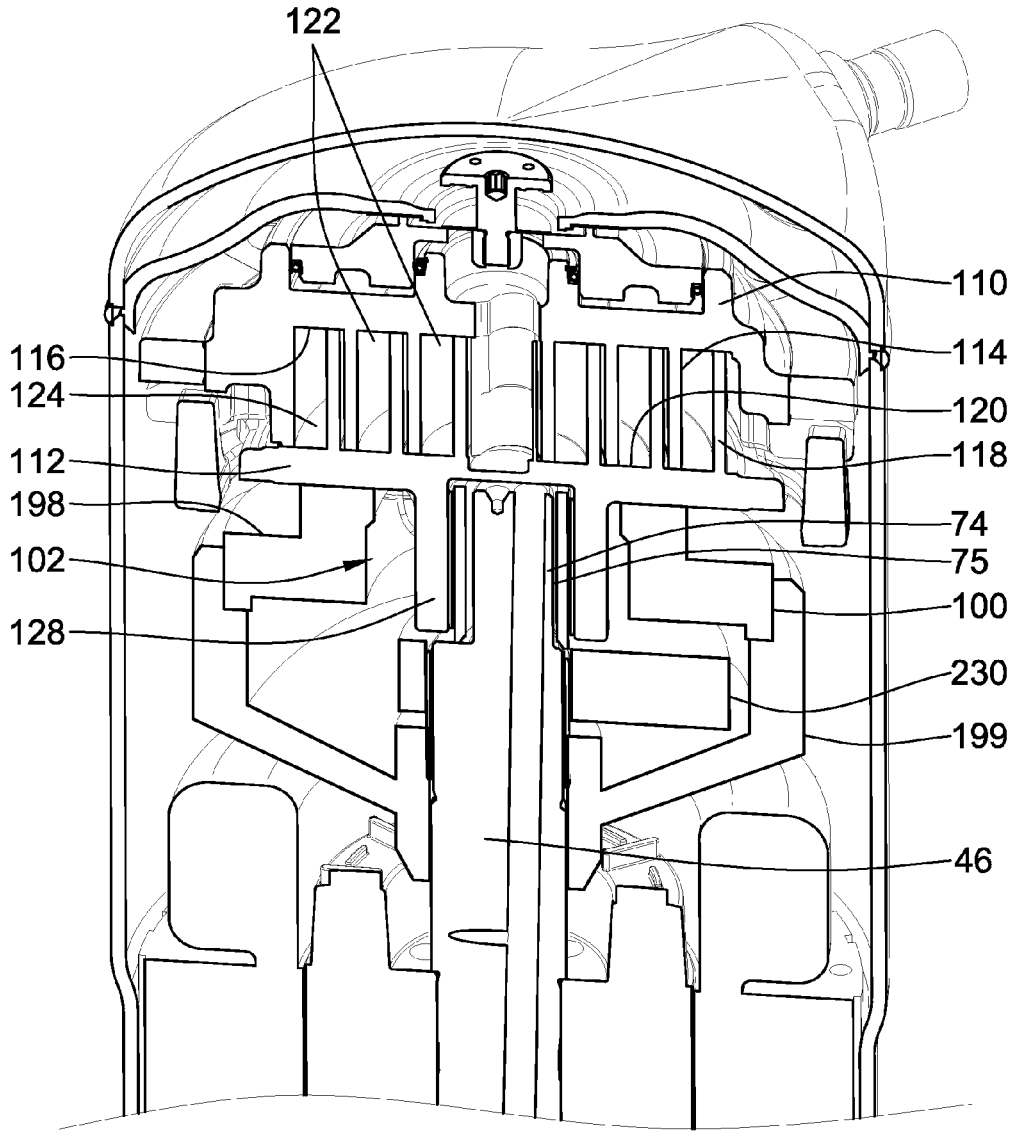
FIG. 14 is a cross-sectional isometric view of a portion of a scroll compressor assembly, constructed in accordance with an embodiment of the invention.

The upper bearing member or crankcase 42 also provides axial thrust support to the movable scroll compressor body 112 through a bearing support via an axial thrust surface 96 of the thrust bearing 84. While, as shown FIGS. 1-3, the crankcase 42 may be integrally provided by a single unitary component, FIGS. 13 and 14 show an alternate embodiment in which the axial thrust support is provided by a separate collar member 198 that is assembled and concentrically located within the upper portion of the upper bearing member 199 along stepped annular interface 100. The collar member 198 defines a central opening 102 that is a size large enough to clear a cylindrical bushing drive hub 128 of the movable scroll compressor body 112 in addition to the eccentric offset drive section 74, and allow for orbital eccentric movement thereof.

Turning in greater detail to the scroll compressor 14, the scroll compressor includes first and second scroll compressor bodies which preferably include a stationary fixed scroll compressor body 110 and a movable scroll compressor body 112. While the term "fixed" generally means stationary or immovable in the context of this application, more specifically "fixed" refers to the non-orbiting, non-driven scroll member, as it is acknowledged that some limited range of axial, radial, and rotational movement is possible due to thermal expansion and/or design tolerances.

The movable scroll compressor body 112 is arranged for orbital movement relative to the fixed scroll compressor body 110 for the purpose of compressing refrigerant. The fixed scroll compressor body includes a first rib 114 projecting axially from a plate-like base 116 and is designed in the form of a spiral. Similarly, the movable scroll compressor body 112 includes a second scroll rib 118 projecting axially from a plate-like base 120 and is in the shape of a similar spiral. The scroll ribs 114, 118 engage in one another and abut sealingly on the respective surfaces of bases 120, 116 of the respectively other compressor body 112, 110. As a result, multiple compression chambers 122 are formed between the scroll ribs 114, 118 and the bases 120, 116 of the compressor bodies 112, 110. Within the chambers 122, progressive compression of refrigerant takes place. Refrigerant flows with an initial low pressure via an intake area 124 surrounding the scroll ribs 114, 118 in the outer radial region (see e.g. FIGS. 1-2). Following the progressive compression in the chambers 122 (as the chambers progressively are defined radially inward), the refrigerant exits via a compression outlet 126 which is defined centrally within the base 116 of the fixed scroll compressor body 110. Refrigerant that has been compressed to a high pressure can exit the chambers 122 via the compression outlet 126 during operation of the scroll compressor 14.

The movable scroll compressor body 112 engages the eccentric offset drive section 74 of the drive shaft 46. More specifically, the receiving portion of the movable scroll compressor body 112 includes the cylindrical bushing drive hub 128 which slideably receives the eccentric offset drive section 74 with a slideable bearing surface provided therein. In detail, the eccentric offset drive section 74 engages the cylindrical bushing drive hub 128 in order to move the movable scroll compressor body 112 about an orbital path about the central axis 54 during rotation of the drive shaft 46 about the central axis 54. Considering that this offset relationship causes a weight imbalance relative to the central axis 54, the assembly typically includes a counterweight 130 that is mounted at a fixed angular orientation to the drive shaft 46. The counterweight 130 acts to offset the weight imbalance caused by the eccentric offset drive section 74 and the movable scroll compressor body 112 that is driven about an orbital path. The counterweight 130 includes an attachment collar 132 and an offset weight region 134 (see counterweight 130 shown best in FIGS. 2 and 3) that provides for the counterweight effect and thereby balancing of the overall weight of the components rotating about the central axis 54. This provides for reduced vibration and noise of the overall assembly by internally balancing or cancelling out inertial forces.

Figure 4:
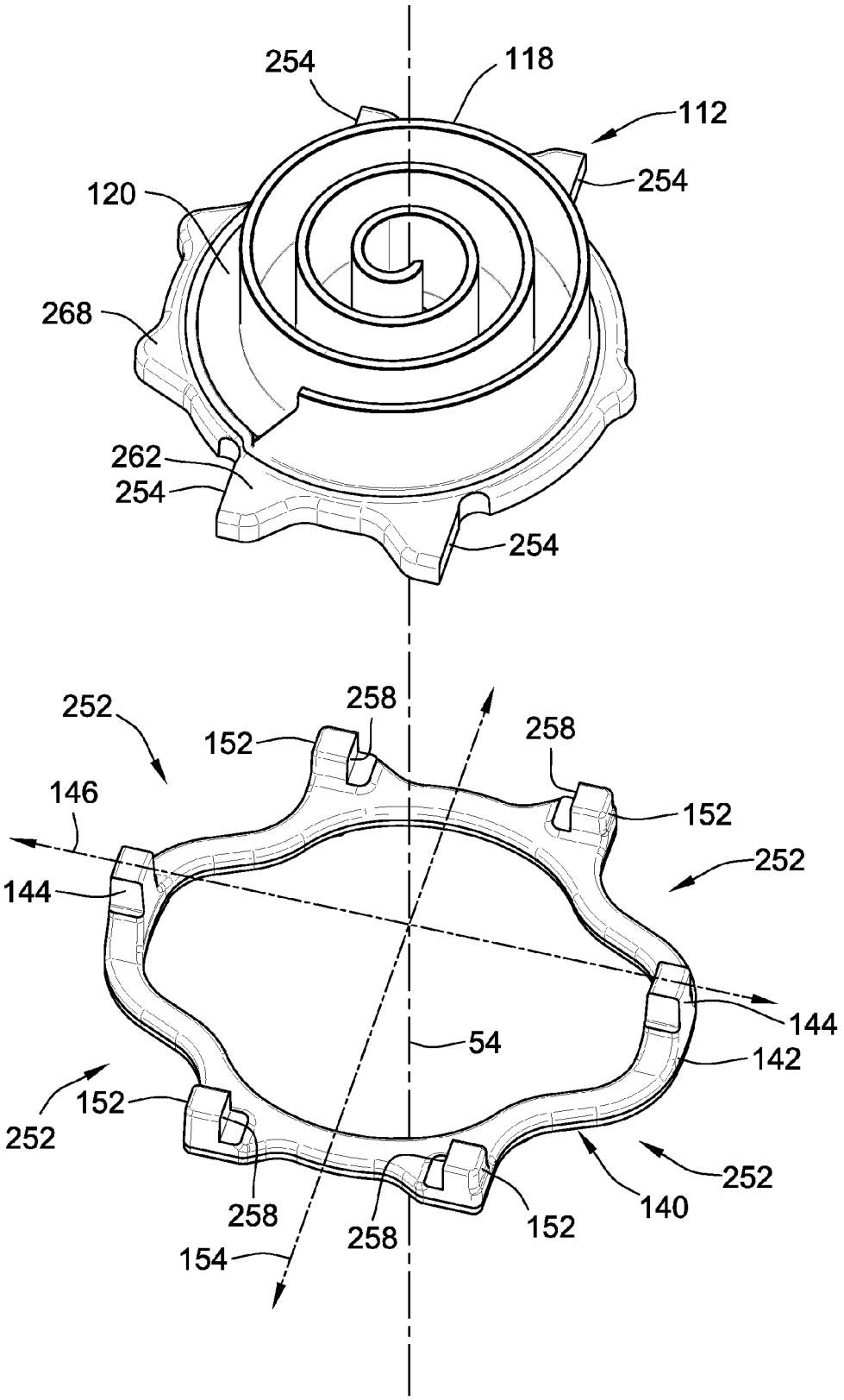
FIG. 4 is a perspective view of an exemplary key coupling and movable scroll compressor body, according to an embodiment of the invention.
Figure 7:
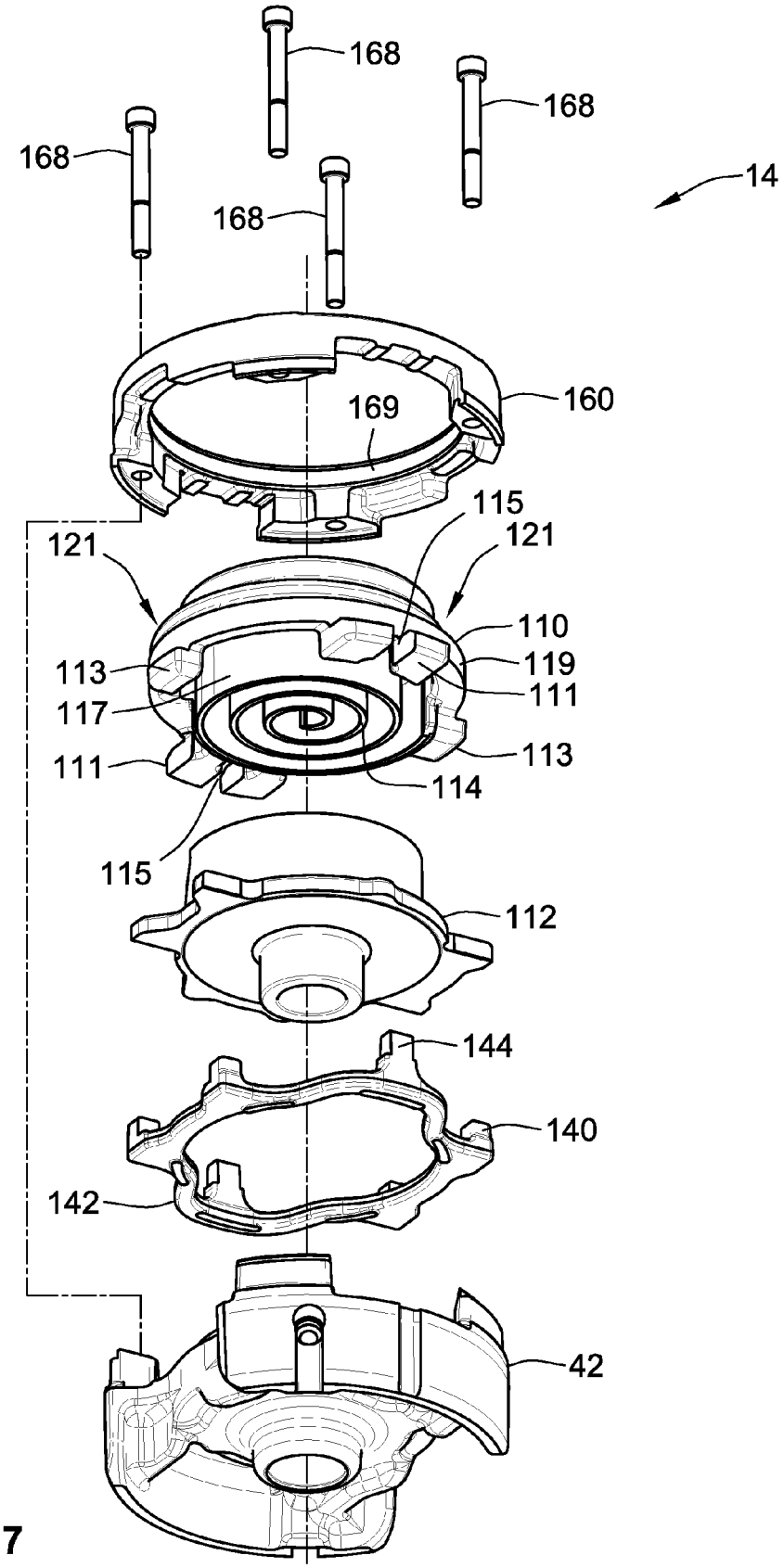
FIG. 7 is an exploded isometric view of the pilot ring, crankcase, key coupler and scroll compressor bodies, according to an embodiment of the invention.

With reference to FIGS. 4 and 7, the guiding movement of the scroll compressor 14 can be seen. To guide the orbital movement of the movable scroll compressor body 112 relative to the fixed scroll compressor body 110, an appropriate key coupling 140 may be provided. Keyed couplings 140 are often referred to in the scroll compressor art as an "Oldham Coupling." In this embodiment, the key coupling 140 includes an outer ring body 142 and includes two axially-projecting first keys 144 that are linearly spaced along a first lateral axis 146 and that slide closely and linearly within two respective keyway tracks or slots 115 (shown in FIGS. 1 and 2) of the fixed scroll compressor body 110 that are linearly spaced and aligned along the first axis 146 as well. The slots 115 are defined by the stationary fixed scroll compressor body 110 such that the linear movement of the key coupling 140 along the first lateral axis 146 is a linear movement relative to the outer housing 12 and perpendicular to the central axis 54. The keys can comprise slots, grooves or, as shown, projections which project axially (i.e., parallel to central axis 54) from the ring body 142 of the key coupling 140. This control of movement along the first lateral axis 146 guides part of the overall orbital path of the movable scroll compressor body 112.

Referring specifically to FIG. 4, the key coupling 140 includes four axially-projecting second keys 152 in which opposed pairs of the second keys 152 are linearly aligned substantially parallel relative to a second transverse lateral axis 154 that is perpendicular to the first lateral axis 146. There are two sets of the second keys 152 that act cooperatively to receive projecting sliding guide portions 254 that project from the base 120 on opposite sides of the movable scroll compressor body 112. The guide portions 254 linearly engage and are guided for linear movement along the second transverse lateral axis by virtue of sliding linear guiding movement of the guide portions 254 along sets of the second keys 152.

It can be seen in FIG. 4 that four sliding contact surfaces 258 are provided on the four axially-projecting second keys 152 of the key coupling 140. As shown, each of the sliding contact surfaces 258 is contained in its own separate quadrant 252 (the quadrants 252 being defined by the mutually perpendicular lateral axes 146, 154). As shown, cooperating pairs of the sliding contact surfaces 258 are provided on each side of the first lateral axis 146.

By virtue of the key coupling 140, the movable scroll compressor body 112 has movement restrained relative to the fixed scroll compressor body 110 along the first lateral axis 146 and second transverse lateral axis 154. This results in the prevention of relative rotation of the movable scroll body as it allows only translational motion. More particularly, the fixed scroll compressor body 110 limits motion of the key coupling 140 to linear movement along the first lateral axis 146; and in turn, the key coupling 140 when moving along the first lateral axis 146 carries the movable scroll 112 along the first lateral axis 146 therewith. Additionally, the movable scroll compressor body 112 can independently move relative to the key coupling 140 along the second transverse lateral axis 154 by virtue of relative sliding movement afforded by the guide portions 254 which are received and slide between the second keys 152. By allowing for simultaneous movement in two mutually perpendicular axes 146, 154, the eccentric motion that is afforded by the eccentric offset drive section 74 of the drive shaft 46 upon the cylindrical bushing drive hub 128 of the movable scroll compressor body 112 is translated into an orbital path movement of the movable scroll compressor body 112 relative to the fixed scroll compressor body 110.

The movable scroll compressor body 112 also includes flange portions 268 projecting in a direction perpendicular relative to the guiding flange portions 262 (e.g. along the first lateral axis 146). These additional flange portions 268 are preferably contained within the diametrical boundary created by the guide flange portions 262 so as to best realize the size reduction benefits. Yet a further advantage of this design is that the sliding faces 254 of the movable scroll compressor body 112 are open and not contained within a slot. This is advantageous during manufacture in that it affords subsequent machining operations such as finishing milling for creating the desirable tolerances and running clearances as may be desired.

Figure 5:
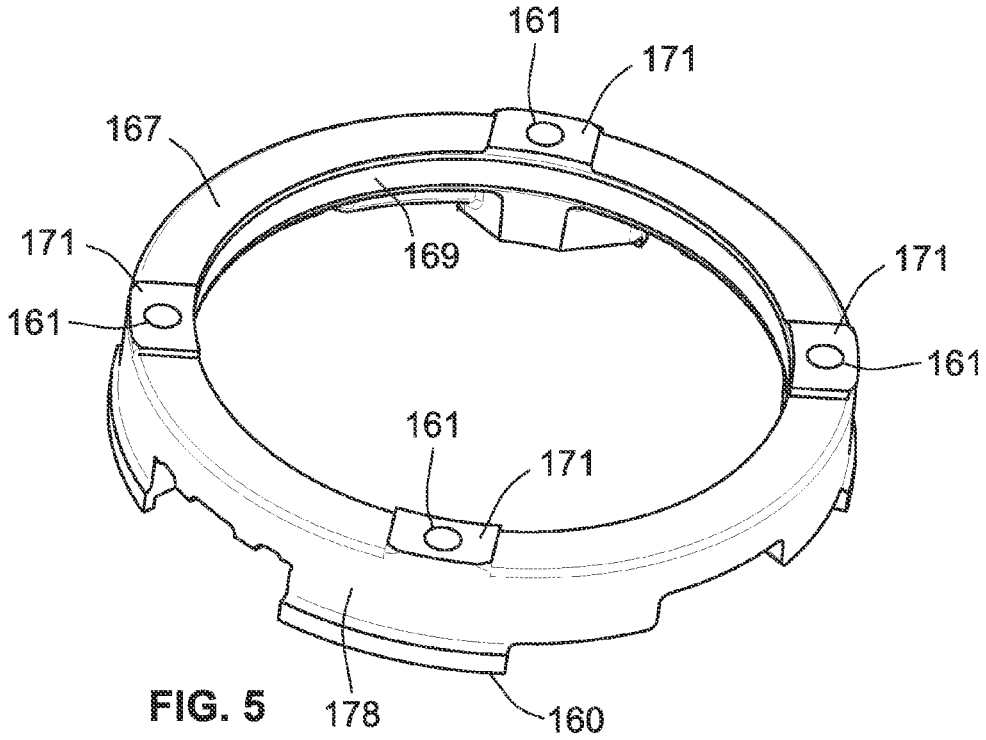
FIG. 5 is a top isometric view of the pilot ring, constructed in accordance with an embodiment of the invention.

Generally, scroll compressors with movable and fixed scroll compressor bodies require some type of restraint for the fixed scroll compressor body 110 which restricts the radial movement and rotational movement but which allows some degree of axial movement so that the fixed and movable scroll compressor bodies 110, 112 are not damaged during operation of the scroll compressor 14. In embodiments of the invention, that restraint is provided by a pilot ring 160, as shown in FIGS. 5-9. FIG. 5 shows the top side of pilot ring 160, constructed in accordance with an embodiment of the invention. The pilot ring 160 has a top surface 167, a cylindrical outer perimeter surface 178, and a cylindrical first inner wall 169. The pilot ring 160 of FIG. 5 includes four holes 161 through which fasteners, such as threaded bolts, may be inserted to allow for attachment of the pilot ring 160 to the crankcase 42. In a particular embodiment, the pilot ring 160 has axially-raised portions 171 (also referred to as mounting bosses) where the holes 161 are located. One of skill in the art will recognize that alternate embodiments of the pilot ring may have greater or fewer than four holes for fasteners. The pilot ring 160 may be a machined metal casting, or, in alternate embodiments, a machined component of iron, steel, aluminum, or some other similarly suitable material.

Figure 6:
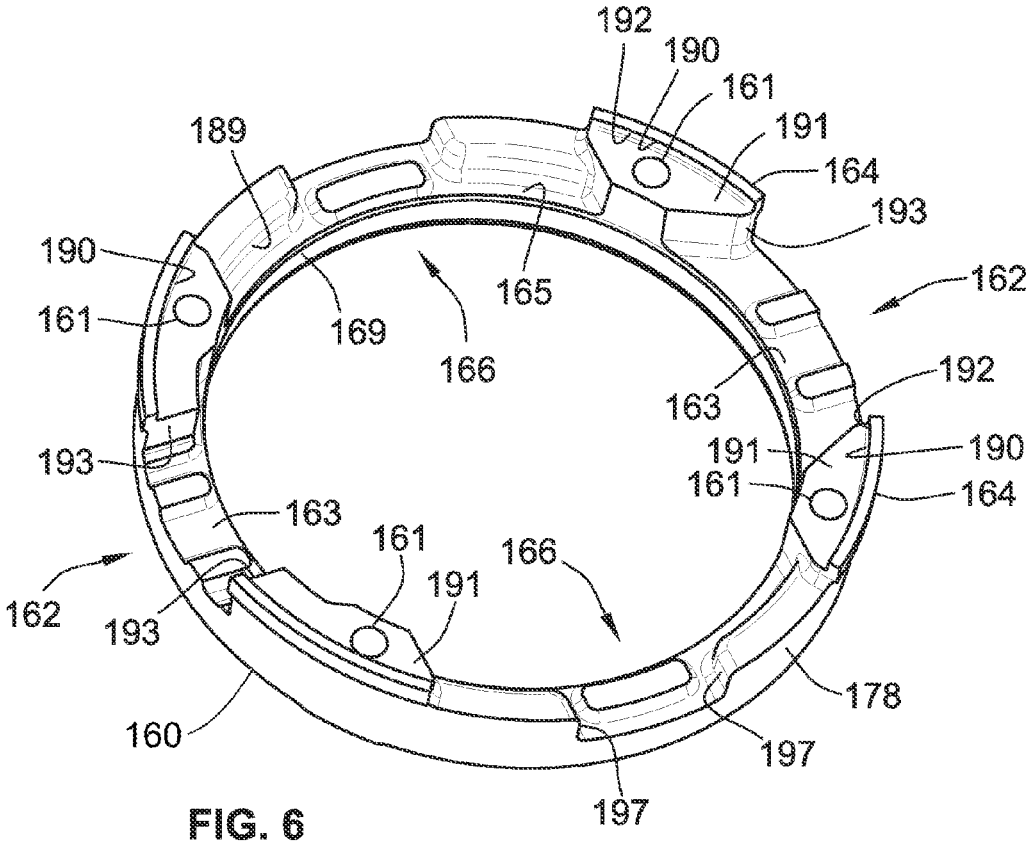
FIG. 6 is a bottom isometric view of the pilot ring of FIG. 5.

FIG. 6 shows a bottom view of the pilot ring 160 showing the four holes 161 along with two slots 162 formed into the pilot ring 160. In the embodiment of FIG. 6, the slots 162 are spaced approximately 180 degrees apart on the pilot ring 160. Each slot 162 is bounded on two sides by axially-extending side walls 193. As shown in FIG. 6, the bottom side of the pilot ring 160 includes a base portion 163 which is continuous around the entire circumference of the pilot ring 160 forming a complete cylinder. But on each side of the two slots 162, there is a semi-circular stepped portion 164 which covers some of the base portion 163 such that a ledge 165 is formed on the part of the pilot ring 160 radially inward of each semi-circular stepped portion 164. The inner-most diameter or the ledge 165 is bounded by the first inner wall 169.

A second inner wall 189 runs along the inner diameter of each semi-circular stepped portion 164. Each semi-circular stepped portion 164 further includes a bottom surface 191, a notched section 166, and a chamfered lip 190. In the embodiment of FIG. 6, each chamfered lip 190 runs the entire length of the semi-circular stepped portion 164 making the chamfered lip 190 semi-circular as well. Each chamfered lip 190 is located on the radially-outermost edge of the bottom surface 191, and extends axially from the bottom surface 191. Further, each chamfered lip 190 includes a chamfered edge surface 192 on an inner radius of the chamfered lip 190. When assembled, the chamfered edge surface 192 is configured to mate with the chamfered edge 94 on each post 89 of the crankcase. The mating of these chamfered surfaces allows for an easier, better-fitting assembly, and reduces the likelihood of assembly problems due to manufacturing tolerances.

In the embodiment of FIG. 6, the notched sections 166 are approximately 180 degrees apart on the pilot ring 160, and each is about midway between the two ends of the semi-circular stepped portion 164. The notched sections 166 are bounded on the sides by sidewall sections 197. Notched sections 166 thus extend radially and axially into the semi-circular stepped portion 164 of the pilot ring 160.

FIG. 7 shows an exploded view of the scroll compressor 14 assembly, according to an embodiment of the invention. The top-most component shown is the pilot ring 160 which is adapted to fit over the top of the fixed scroll compressor body 110. The fixed scroll compressor body 110 has a pair of first radially-outward projecting limit tabs 111. In the embodiment of FIG. 7, one of the pair of first radially-outward projecting limit tabs 111 is attached to an outermost perimeter surface 117 of the first scroll rib 114, while the other of the pair of first radially-outward projecting limit tabs 111 is attached to a perimeter portion of the fixed scroll compressor body 110 below a perimeter surface 119. In further embodiments, the pair of first radially-outward projecting limit tabs 111 are spaced approximately 180 degrees apart. Additionally, in particular embodiments, each of the pair of first radially-outward-projecting limit tabs 111 has a slot 115 therein. In particular embodiments, the slot 115 may be a U-shaped opening, a rectangular-shaped opening, or have some other suitable shape.

The fixed scroll compressor body 110 also has a pair of second radially-outward projecting limit tabs 113, which, in this embodiment, are spaced approximately 180 degrees apart. In certain embodiments, the second radially-outward projecting limit tabs 113 share a common plane with the first radially-outward-projecting limit tabs 111. Additionally, in the embodiment of FIG. 7, one of the pair of second radially-outward projecting limit tabs 113 is attached to an outermost perimeter surface 117 of the first scroll rib 114, while the other of the pair of second radially-outward projecting limit tabs 113 is attached to a perimeter portion of the fixed scroll compressor body 110 below the perimeter surface 119. The movable scroll compressor body 112 is configured to be held within the keys of the key coupling 140 and mates with the fixed scroll compressor body 110. As explained above, the key coupling 140 has two axially-projecting first keys 144, which are configured to be received within the slots 115 in the first radially-outward-projecting limit tabs 111. When assembled, the key coupling 140, fixed and movable scroll compressor bodies 110, 112 are all configured to be disposed within crankcase 42, which can be attached the to the pilot ring 160 by the threaded bolts 168 shown above the pilot ring 160.

Referring still to FIG. 7, the fixed scroll compressor body 110 includes plate-like base 116 (see FIG. 14) and a perimeter surface 119 spaced axially from the plate-like base 116. In a particular embodiment, the entirety of the perimeter surface 119 surrounds the first scroll rib 114 of the fixed scroll compressor body 110, and is configured to abut the first inner wall 169 of the pilot ring 160, though embodiments are contemplated in which the engagement of the pilot ring and fixed scroll compressor body involve less than the entire circumference. In particular embodiments of the invention, the first inner wall 169 is precisely toleranced to fit snugly around the perimeter surface 119 to thereby limit radial movement of the first scroll compressor body 110, and thus provide radial restraint for the first scroll compressor body 110. The plate-like base 116 further includes a radially-extending top surface 121 that extends radially inward from the perimeter surface 119. The radially-extending top surface 121 extends radially inward towards a step-shaped portion 123 (see FIG. 8). From this step-shaped portion 123, a cylindrical inner hub region 172 and peripheral rim 174 extend axially (i.e., parallel to central axis 54, when assembled into scroll compressor assembly 10).

Figure 8:
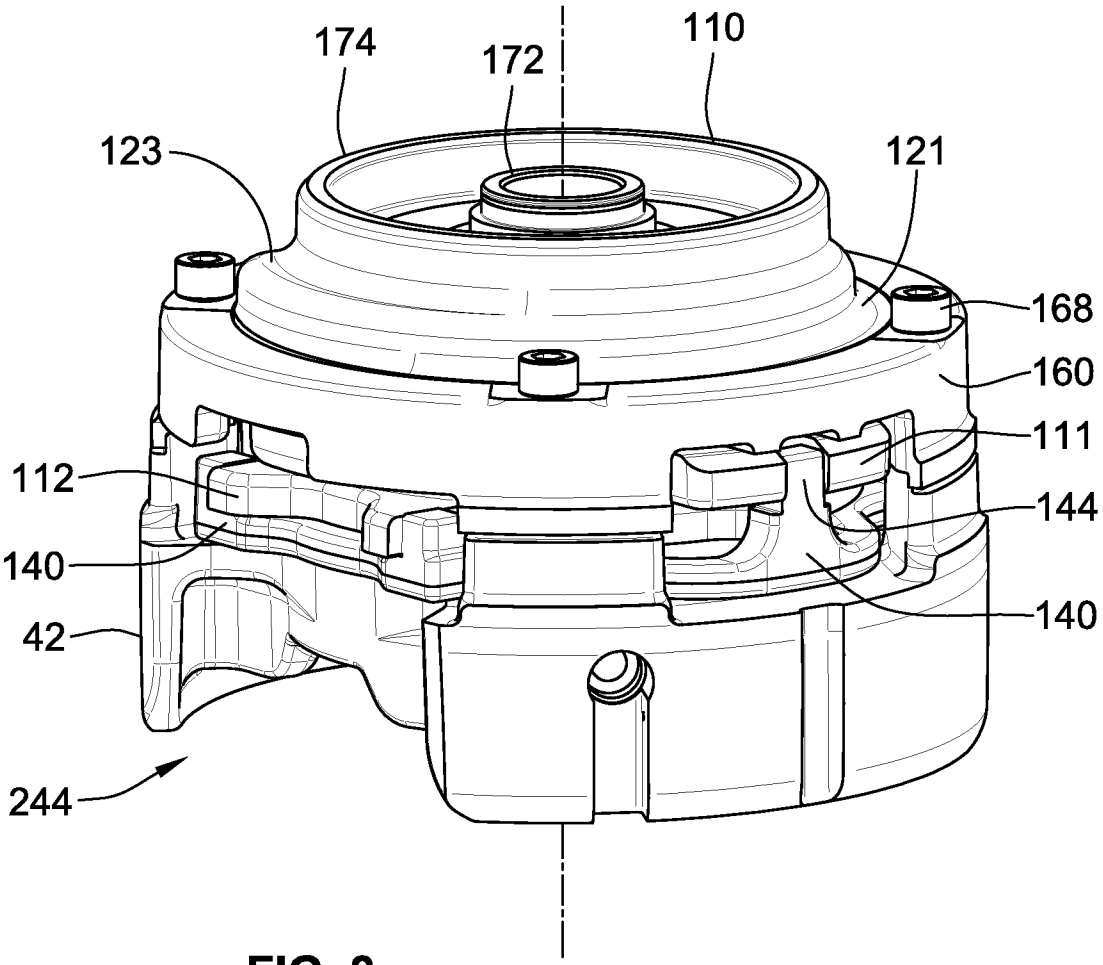
FIG. 8 is a isometric view of the components of FIG. 7 shown assembled.

FIG. 8 shows the components of FIG. 7 fully assembled. The pilot ring 160 securely holds the fixed scroll compressor body 110 in place with respect to the movable scroll compressor body 112 and key coupling 140. The threaded bolts 168 attach the pilot ring 160 and crankcase 42. As can be seen from FIG. 8, each of the pair of first radially-outward projecting limit tabs 111 is positioned in its respective slot 162 of the pilot ring 160. As stated above, the slots 115 in the pair of first radially-outward projecting limit tabs 111 are configured to receive the two axially-projecting first keys 144. In this manner, the pair of first radially-outward projecting limit tabs 111 engage the side portion 193 of the pilot ring slots 162 to prevent rotation of the fixed scroll compressor body 110, while the key coupling first keys 144 engage a side portion of the slot 115 to prevent rotations of the key coupling 140. Limit tabs 111 also provide additional (to limit tabs 113) axial limit stops.

Though not visible in the view of FIG. 8, each of the pair of second radially-outward projecting limit tabs 113 (see FIG. 7) is nested in its respective notched section 166 of the pilot ring 160 to constrain axial movement of the fixed scroll compressor body 110 thereby defining a limit to the available range of axial movement of the fixed scroll compressor body 110. The pilot ring notched sections 166 are configured to provide some clearance between the pilot ring 160 and the pair of second radially-outward projecting limit tabs 113 to provide for axial restraint between the fixed and movable scroll compressor bodies 110, 112 during scroll compressor operation. However, the radially-outward projecting limit tabs 113 and notched sections 166 also keep the extent of axial movement of the fixed scroll compressor body 110 to within an acceptable range.

It should be noted that "limit tab" is used generically to refer to either or both of the radially-outward projecting limit tabs 111, 113. Embodiments of the invention may include just one of the pairs of the radially-outward projecting limit tabs, or possibly just one radially-outward projecting limit tab, and particular claims herein may encompass these various alternative embodiments As illustrated in FIG. 8, the crankcase 42 and pilot ring 160 design allow for the key coupling 140, and the fixed and movable scroll compressor bodies 110, 112 to be of a diameter that is approximately equal to that of the crankcase 42 and pilot ring 160. As shown in FIG. 1, the perimeters of these components may abut or nearly abut the inner surface of the outer housing 12, and, as such, the diameter of each of these components is approximately equal to the inner diameter of the outer housing 12. It is also evident that when the key coupling 140 is as large as the surrounding compressor outer housing 12 allows, this in turn provides more room inside the key coupling 140 for a larger thrust bearing which in turn allows a larger scroll set. This maximizes the scroll compressor 14 displacement available within a given diameter outer housing 12, and thus uses less material at less cost than in conventional scroll compressor designs.

It is contemplated that the embodiments of FIGS. 7 and 8 in which the first scroll compressor body 110 includes four radially-outward projecting limit tabs 111, 113, these limit tabs 111, 113 could provide radial restraint of the first scroll compressor body 110, as well as axial and rotation restraint. For example, radially-outward projecting limit tabs 113 could be configured to fit snugly with notched sections 166 such that these limit tabs 113 sufficiently limit radial movement of the first scroll compressor body 110 along first lateral axis 146. Additionally, each of the radially-outward-projecting limit tabs 111 could have a notched portion configured to abut the portion of the first inner wall 169 adjacent the slots 162 of the pilot ring 160 to provide radial restraint along second lateral axis 154. While this approach could potentially require maintaining a certain tolerance for the limit tabs 111, 113 or the notched section 166 and slots 162, in these instances, there would be no need to precisely tolerance the entire first inner wall 169 of the pilot ring 160, as this particular feature would not be needed to provide radial restraint of the first scroll compressor body 110.

Figure 11:
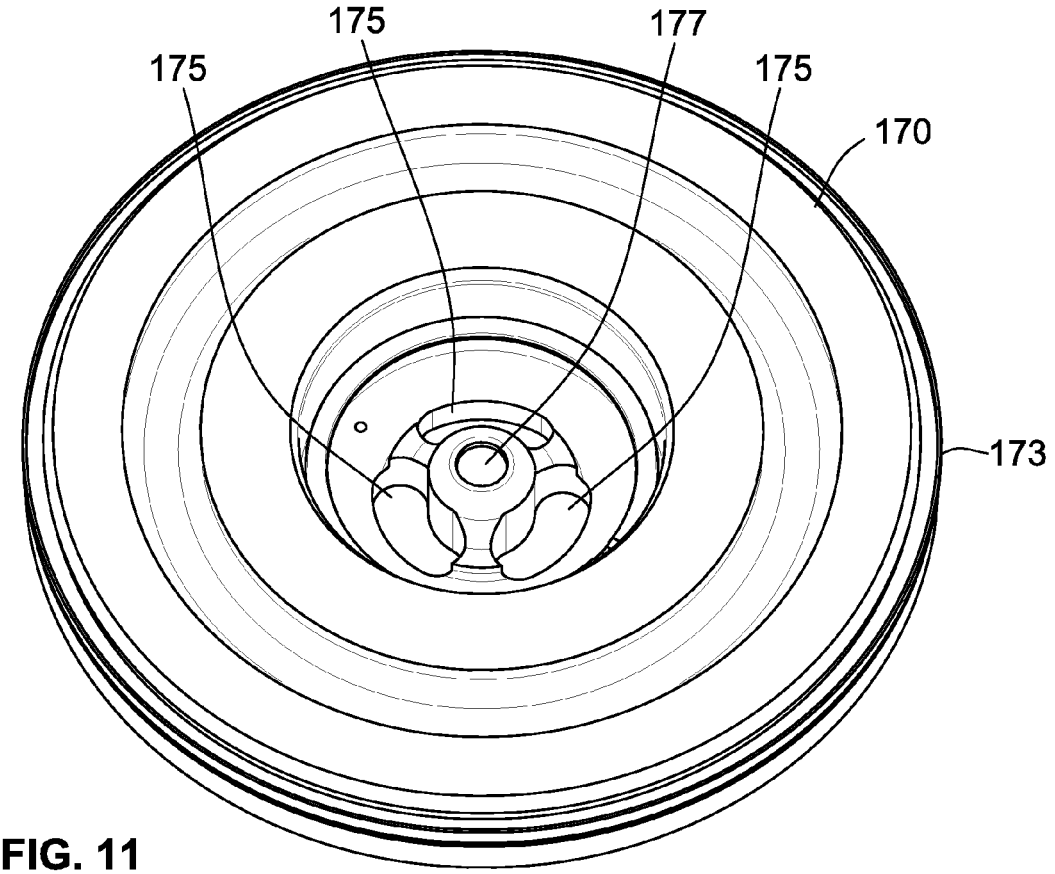
FIG. 11 is a bottom isometric view of the floating seal, according to an embodiment of the invention.
Figure 12:
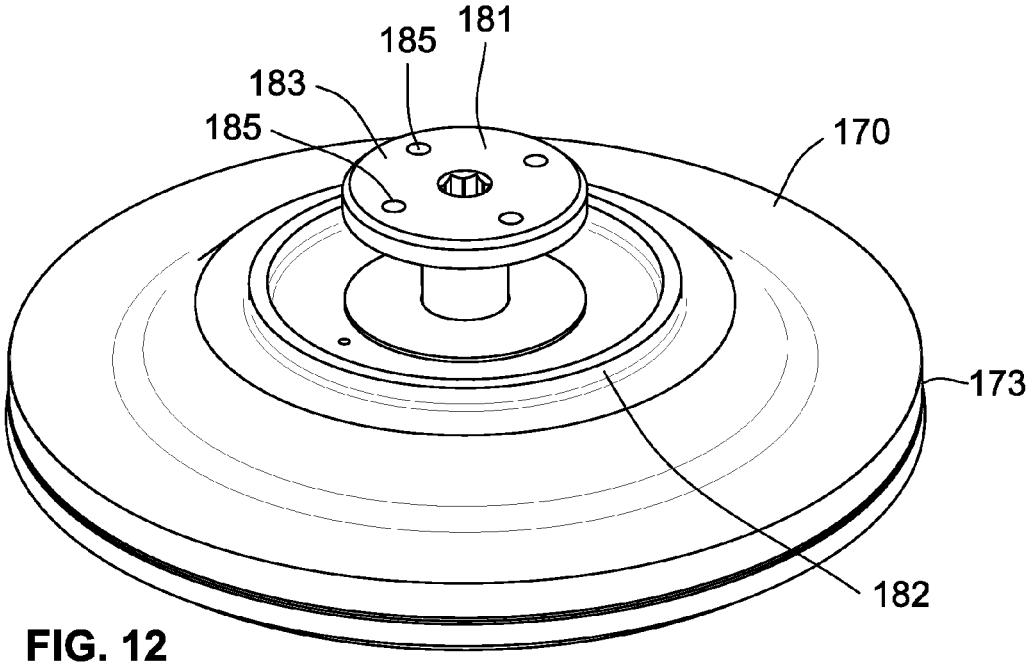
FIG. 12 is a top isometric view of the floating seal of FIG. 11.

With reference to FIGS. 9-12, the upper side (e.g. the side opposite the scroll rib) of the fixed scroll 110 supports a floating seal 170 above which is disposed the separator plate 30. In the embodiment shown, to accommodate the floating seal 170, the upper side of the fixed scroll compressor body 110 includes an annular and, more specifically, the cylindrical inner hub region 172, and the peripheral rim 174 spaced radially outward from the inner hub region 172. The inner hub region 172 and the peripheral rim 174 are connected by a radially-extending disc region 176 of the base 116. As shown in FIG. 11, the underside of the floating seal 170 has circular cutout adapted to accommodate the inner hub region 172 of the fixed scroll compressor body 110. Further, as can be seen from FIGS. 9 and 10, the perimeter wall 173 of the floating seal is adapted to fit somewhat snugly inside the peripheral rim 174. In this manner, the fixed scroll compressor body 110 centers and holds the floating seal 170 with respect to the central axis 54.

Figure 9:
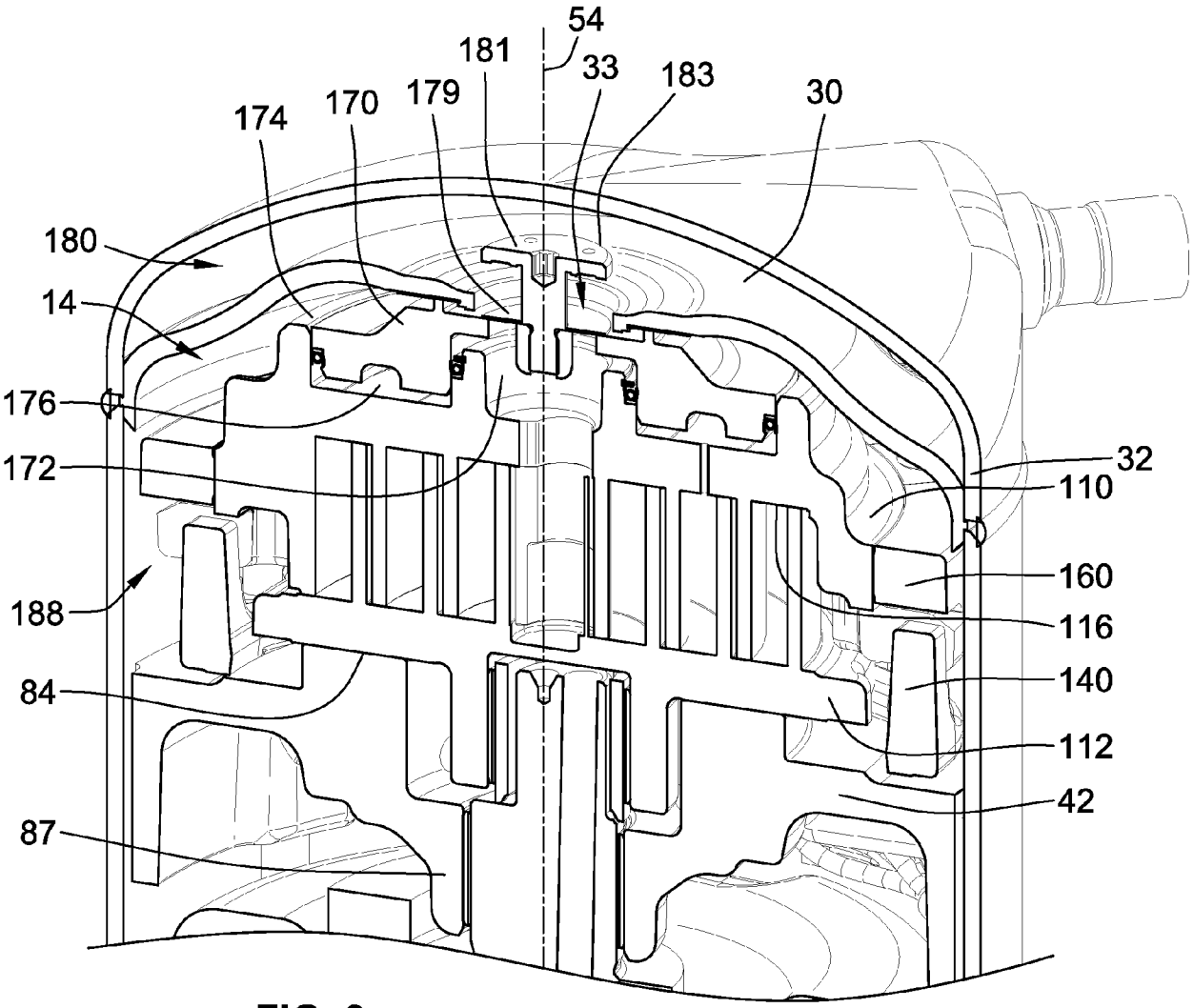
FIG. 9 is a cross-sectional isometric view of the components in the top end section of the outer housing, according to an embodiment of the invention.
Figure 10:
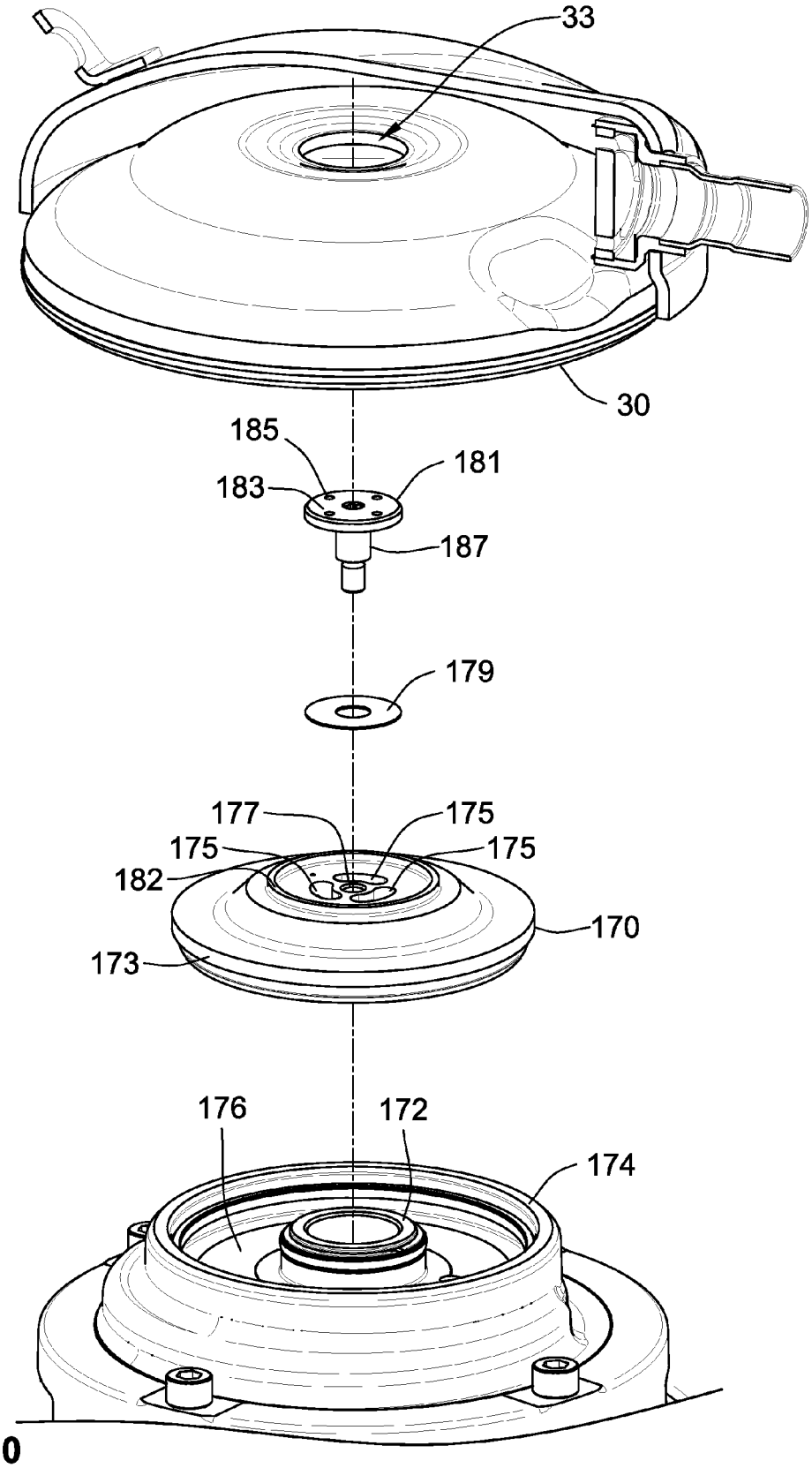
FIG. 10 is an exploded isometric view of the components of FIG. 9.

In a particular embodiment of the invention, a central region of the floating seal 170 includes a plurality of openings 175. In the embodiment shown, one of the plurality of openings 175 is centered on the central axis 54. That central opening 177 is adapted to receive a rod 181 which is affixed to the floating seal 170. As shown in FIGS. 9 through 12, a ring valve 179 is assembled to the floating seal 170 such that the ring valve 179 covers the plurality of openings 175 in the floating seal 170, except for the central opening 177 through which the rod 181 is inserted. The rod 181 includes an upper flange 183 with a plurality of openings 185 therethrough, and a stem 187. As can be seen in FIG. 9, the pin through separator plate 30 has a center hole 33. The upper flange 183 of rod 181 is adapted to pass through the center hole 33, while the stem 187 is inserted through central opening 177. The ring valve 179 slides up and down the rod 181 as needed to prevent back flow from a high-pressure chamber 180. With this arrangement, the combination of the separator plate 30, the fixed scroll compressor body 110, and floating seal 170 serve to separate the high pressure chamber 180 from a lower pressure region 188 within the outer housing 12. Rod 181 guides and limits the motion of the ring valve 179. While the separator plate 30 is shown as engaging and constrained radially within the cylindrical side wall region 32 of the top end housing section 26, the separator plate 30 could alternatively be cylindrically located and axially supported by some portion or component of the scroll compressor 14.

In certain embodiments, when the floating seal 170 is installed in the space between the inner hub region 172 and the peripheral rim 174, the space beneath the floating seal 170 is pressurized by a vent hole (not shown) drilled through the fixed scroll compressor body 110 to chamber 122 (shown in FIG. 2). This pushes the floating seal 170 up against the separator plate 30 (shown in FIG. 9). A circular rib 182 presses against the underside of the separator plate 30 forming a seal between high-pressure discharge gas and low-pressure suction gas.

While the separator plate 30 could be a stamped steel component, it could also be constructed as a cast and/or machined member (and may be made from steel or aluminum) to provide the ability and structural features necessary to operate in proximity to the high-pressure refrigerant gases output by the scroll compressor 14. By casting or machining the separator plate 30 in this manner, heavy stamping of such components can be avoided.

During operation, the scroll compressor assembly 10 is operable to receive low-pressure refrigerant at the housing inlet port 18 and compress the refrigerant for delivery to the high-pressure chamber 180 where it can be output through the housing outlet port 20. This allows the low-pressure refrigerant to flow across the electrical motor assembly 40 and thereby cool and carry away from the electrical motor assembly 40 the heat which can be generated by operation of the motor. Low-pressure refrigerant can then pass longitudinally through the electrical motor assembly 40, around and through void spaces therein toward the scroll compressor 14. The low-pressure refrigerant fills the chamber 31 (shown in FIG. 1) formed between the electrical motor assembly 40(shown in FIG. 1) and the outer housing 12 (shown in FIG. 1). From the chamber 31, the low-pressure refrigerant can pass through the upper bearing member or crankcase 42 through the plurality of spaces 244 that are defined by recesses around the circumference of the crankcase 42 in order to create gaps between the crankcase 42 and the outer housing 12. The plurality of spaces 244 (shown in FIG. 8) may be angularly spaced relative to the circumference of the crankcase 42.

After passing through the plurality of spaces 244 in the crankcase 42, the low-pressure refrigerant then enters the intake area 124 between the fixed and movable scroll compressor bodies 110, 112. From the intake area 124, the low-pressure refrigerant enters between the scroll ribs 114, 118 on opposite sides (one intake on each side of the fixed scroll compressor body 110) and is progressively compressed through chambers 122 until the refrigerant reaches its maximum compressed state at the compression outlet 126 from which it subsequently passes through the floating seal 170 via the plurality of openings 175 and into the high-pressure chamber 180. From this high-pressure chamber 180, high-pressure compressed refrigerant then flows from the scroll compressor assembly 10 through the housing outlet port 20.

FIGS. 13 and 14 illustrate an alternate embodiment of the invention. Instead of a crankcase 42 formed as a single piece, FIGS. 13 and 14 show an upper bearing member or crankcase 199 combined with a separate collar member 198, which provides axial thrust support for the scroll compressor 14. In a particular embodiment, the collar member 198 is assembled into the upper portion of the upper bearing member or crankcase 199 along stepped annular interface 100. Having a separate collar member 198 allows for a counterweight 230 to be assembled within the crankcase 199, which is attached to the pilot ring 160. This allows for a more compact assembly than described in the previous embodiment where the counterweight 130 was located outside of the crankcase 42.

As is evident from the exploded view of FIG. 13 and as stated above, the pilot ring 160 can be attached to the upper bearing member or crankcase 199 via a plurality of threaded fasteners to the upper bearing member 199 in the same manner that it was attached to crankcase 42 in the previous embodiment. The flattened profile of the counterweight 230 allows for it to be nested within an interior portion 201 of the upper bearing member 199 without interfering with the collar member 198, the key coupling 140, or the movable scroll compressor body 112.

Figure 15:
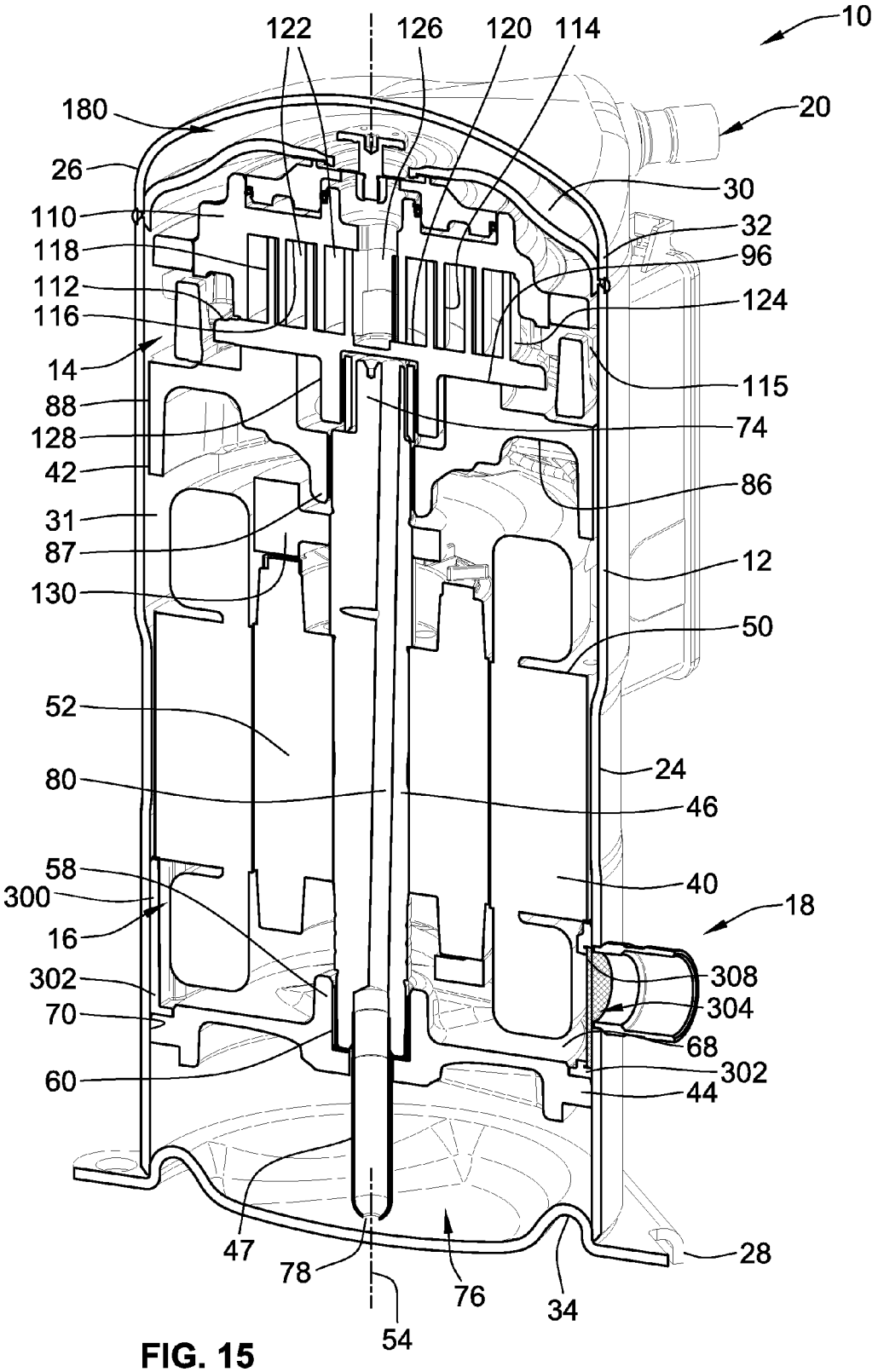
FIG. 15 is a cross-sectional isometric view of a scroll compressor assembly that includes a suction duct situated within the scroll compressor in accordance with a particular embodiment of the present invention.

Turning now to FIGS. 15-25, there are illustrated suction ducts that can be employed and used in any of the compressor embodiments of FIGS. 1-14, or other such compressors. For example, FIG. 15 shows an embodiment of suction duct 300 in use in the scroll compressor assembly of FIG. 1, and as such, like reference numbers are used. The suction duct 300 may comprise a plastic molded ring body 302 that is situated in a flow path through the refrigerant inlet port 18 and in surrounding relation of the motor 40. The suction duct 300 is arranged to direct and guide refrigerant into the motor cavity for cooling the motor while at the same time filtering out contaminants and directing lubricating oil around the periphery of the suction duct 300 to the sump 76.

Figure 16:
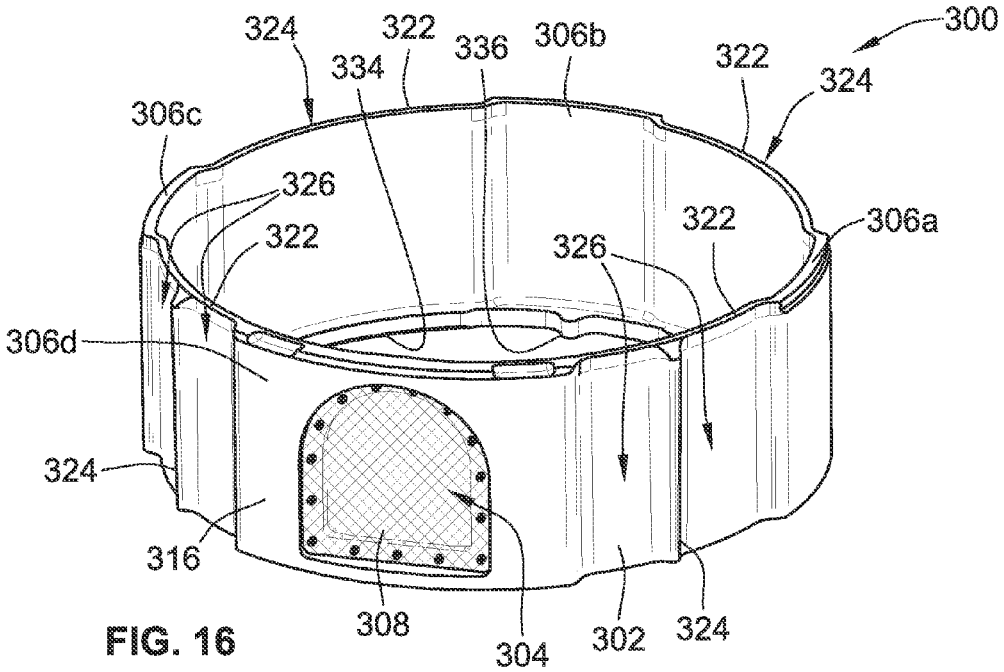
FIG. 16 is an isometric view of a suction duct in accordance with a particular embodiment of the present invention.

As illustrated in FIG. 16, the suction duct 300 has an inlet region and inlet port that may take the form of a window or an opening 304 that aligns with the inlet port 18 (see FIG. 15). To ensure this alignment, suction duct 300 includes a seating ledge 334 and an alignment tab 336. The seating ledge 334 of the suction duct 300 projects radially inward along the bottom periphery of the ring body 302 of the suction duct 300 to seat on the outer periphery of the lower bearing member 44. Further, the seating ledge 334 includes diametric alignment sections 338 formed in spaced relation around the periphery of the ledge 334, which along with the ledge 334, assist in diametrically aligning the suction duct 300 on the lower bearing member 44. The alignment tab 336 is situated on the opposite side of the opening 304 of the ring body 302 and provides a poka-yoke structure for aligning the opening 304 with the inlet port 18.

Additionally, the suction duct 300 includes a screen 308 in the opening 304 that filters refrigerant gas as it enters the compressor through the inlet port 18, as illustrated in FIG. 15. The screen 308 is generally made of metal wire mesh (preferably stainless steel) with the individual pore size of the screen 308 typically ranging from 0.5 to 1.5 millimeters.

Furthermore, the refrigerant gas flowing into the inlet port 18 is cooler than compressed refrigerant gas at the outlet. During operation of the scroll compressor 14, the temperature of the motor 40 will rise. Therefore, it is desirable to cool the motor 40 during operation of the compressor. To accomplish this, cool refrigerant gas that is drawn into the compressor housing 12 via inlet port 18 flows upward through and along the motor 40 in order to reach the scroll compressor 14, thereby cooling the motor 40.

The suction duct 300 is positioned in surrounding relation of the motor 40 and includes a generally arcuate outer surface that is in surface to surface contact with the inner surface of the generally cylindrical housing 12 (see FIG. 15). As illustrated in FIG. 16, the suction duct 300 includes a sealing face 316 that forms a substantial seal between the housing 12 and the section duct 300. The sealing face can surround the window opening 304 and thereby seal around the window 304 to ensure refrigerant flows into the motor cavity. The seal may be air tight, but is not required to be. This typically will ensure that more than 90% of refrigerant gas passes through the screen 308 and preferably at least 99% of refrigerant gas. By having a seal between the sealing face 316 and the portion of the housing 12 surrounding the inlet 18, the suction duct 300 can filter large particles from the refrigerant gas that enters through the inlet port 18, thus preventing unfiltered refrigerant gas from penetrating into the compressor, and can direct the cooling refrigerant into the motor cavity for better cooling of the motor.

Figure 18:
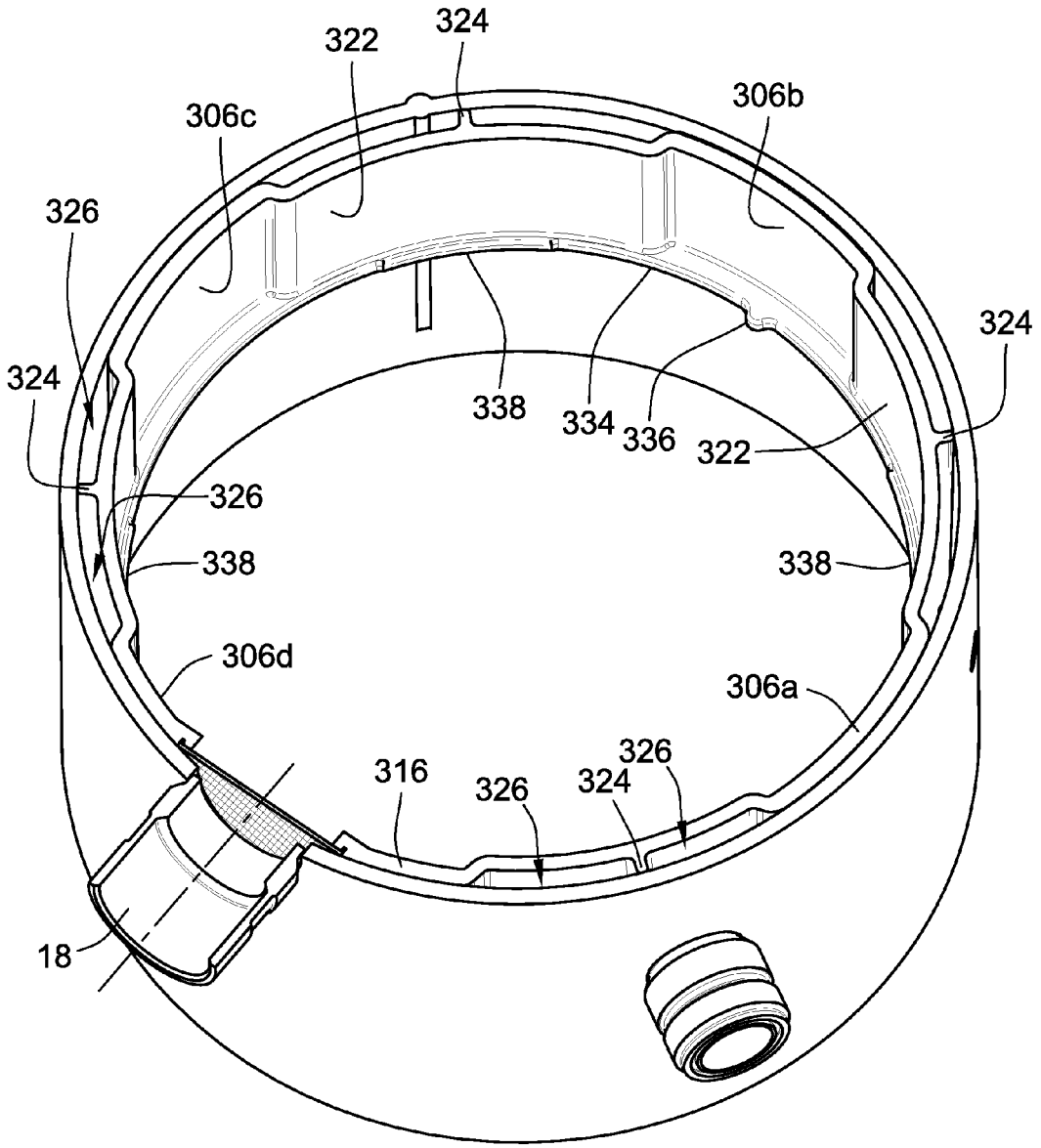
FIG. 18 is an isometric cross section of the scroll compressor and suction duct assembly illustrated in FIG. 15, in accordance with a particular embodiment of the present invention.

Additionally, the suction duct 300 includes outer peripheral arcuate wall sections 306*a*, 306*b*, 306*c*, and 306*d* that each contact the inner cylindrical periphery of the housing 12 (see FIG. 18). One outer peripheral wall section 306*d* also composes the sealing face 316. 306*a*, 306*b*, 306*c*, and 306*d* project radially outward from an inner periphery of recessed wall sections 322 of the suction duct 300. Further, the suction duct 300 may be relieved on the interior surface of the suction duct behind each peripheral wall section 306*a*, 306*b*, 306*c*, and 306*d* to increase spring-like resiliency. Further, the ring body 302 of the suction duct 300 including the outer peripheral wall sections 306*a*, 306*b*, 306*c*, and 306*d* and recessed wall sections 322 are all made from a resilient plastic material to form a spring bias mechanism that along with the undulating nature of the ring body 302 of the suction duct 300 act to apply a pressure between the housing 12 and the sealing face 316 such that the seal is formed at the sealing face 316.

Figure 17:
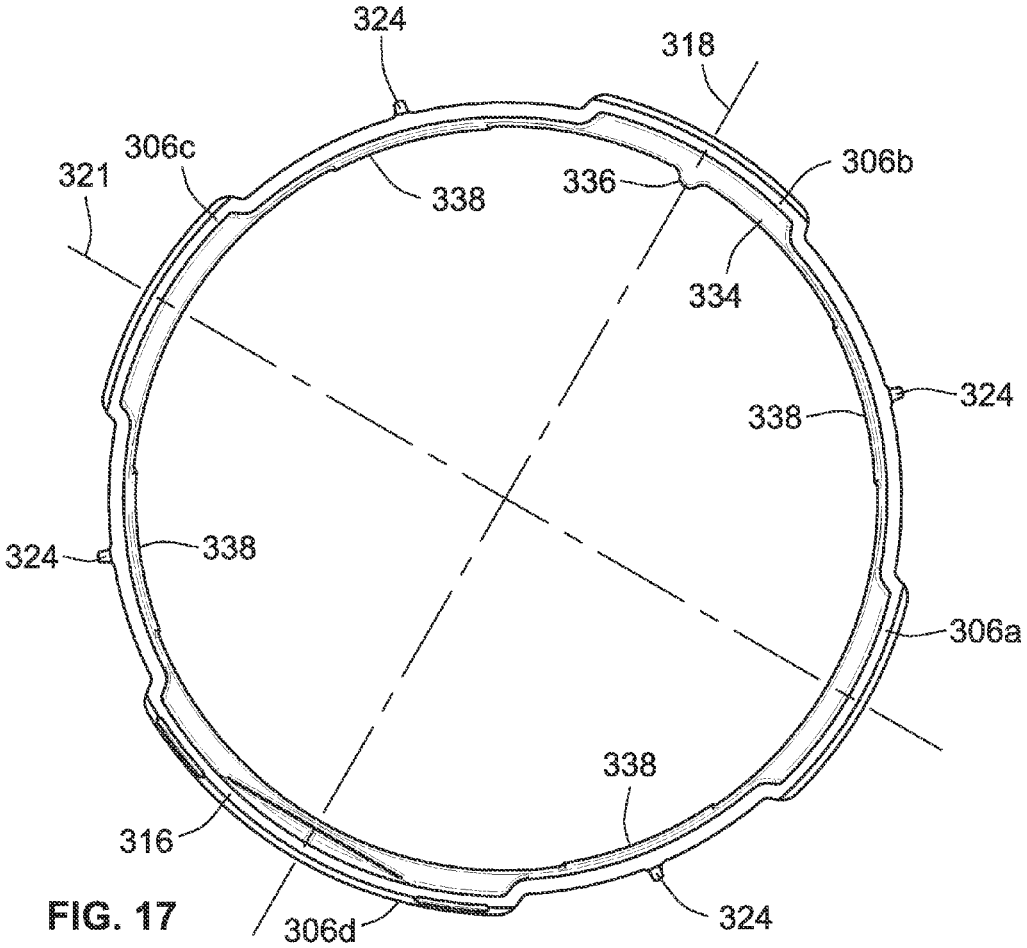
FIG. 17 is a top view of a suction duct in accordance with a particular embodiment of the present invention.

FIG. 17 illustrates the dimensions of the suction duct 300 that act to create the seal of the sealing face 316. An inlet flow axis 318 is defined as an axis that extends along the path of the refrigerant gas as it enters the inlet port 18 (see FIG. 15). Additionally, a transverse axis 321 is defined as well, which is perpendicular to the inlet flow axis. Therefore, the inlet flow axis spans a first distance between the exterior surface of the sealing face 316 or peripheral wall section 306*d* and the exterior surface of the peripheral wall section 306*b*, and the transverse axis spans a second distance between the exterior surfaces of the peripheral wall sections 306*a* and 306*c*. In one embodiment of the suction duct 300, the duct spanning along the transverse axis 321 is slightly longer or wider than the span along the inlet flow axis 318, which causes the ring to resiliently compress and better sealing at the sealing face 316. The span along the transverse axis 321 alternatively or additionally is slightly larger than an inner dimension of the housing to cause resilient compression.

Specifically, peripheral wall sections 306*a* and 306*c* act together as a cooperating pair when the suction duct 300 is assembled into the housing 12 (see FIG. 15). Further, the second distance, defined above as the distance between the exterior surfaces of the peripheral wall sections 306*a* and 306*c*, may be between 0.5% and 5% larger than the first distance, defined above as the distance between the exterior surfaces of the peripheral wall sections 306*d* and 306*b*. Additionally or alternatively, the span of the sections (either one or both pairs) may be slightly greater than the inner diameter of the housing 12 to effect resilient compression of the ring body 302 to cause it to act with spring force Therefore, as the suction duct 300 is assembled, the housing 12 causes a compression of the second distance, along the transverse axis, because the peripheral wall sections 306*a* and 306*c* are compressed against the housing 12. The compression of the second distance causes an expansion of the first distance such that the peripheral wall section 306*b* meets the interior of the housing 12 and pushes peripheral wall section 306*d* or the sealing face 316 into the housing such that a substantial seal is formed. Therefore, peripheral wall sections 306*b* and 306*d* act as another cooperating pair.

In another embodiment of the suction duct 300, the duct spanning along the inlet flow axis 318 is slightly longer or wider than the span along the transverse axis 321. In this particular embodiment, the first distance, defined above as the distance between the exterior surfaces of the peripheral wall sections 306*b* and 306*d*, may be between 0.5% and 5% larger than the second distance, defined above as the distance between the exterior surfaces of the peripheral wall sections 306*a* and 306*c*. The span along the inlet flow axis 318 alternatively or additionally is slightly larger than an inner dimension of the housing to cause resilient compression. In this configuration, as the suction duct 300 is assembled, the housing 12 causes a compression of the first distance (as defined above), along the inlet flow axis 318, because the peripheral wall sections 306*b* and 306*d* are compressed against the housing 12. Further, the compression of the first distance causes an expansion of the second distance such that the peripheral wall sections 306*a* and 306*c* are pushed against the interior of housing 12.

Furthermore, the relative differences between the length of the first and second distances, defined above, allows for some additional tolerance in the shape of the housing 12. Housing 12 is generally cylindrical. Production of housing 12 will not always produce the exact same cylindrical dimensions for every unit produced. However, a sufficient seal should be formed between the sealing face 316 and the housing 12. By having the second distance be sufficiently larger than the first distance or vice-versa, a specific housing 12 dimensional tolerance can be achieved that allows the suction duct 300 to form a substantial seal over the range of housing dimensions produced.

Additionally, the suction duct 300 includes at least one stabilizing rib or ribs 324 that extend radially outward from thin wall or recessed wall sections 322 of the ring body 302 of the suction duct 300. The stabilizing ribs 324 act to maintain an open space between the suction duct 300 and the outer housing 12 (see FIG. 18) and also help maintain shape of suction duct ring 302. The open space acts as a lubricating oil return duct or drainage channel 326 that allows lubricating oil used to lubricate the scroll compressor bodies to drain down the side of the outer housing and flow past the suction duct 300 to pool in the sump 76 (see FIG. 15). Further, each recessed wall section 322 forms one channel 326, and each channel 326 contains at least one stabilizing rib 324, which bisects the channel 326 in two sub-channels.

While the embodiments illustrated in FIGS. 16-18 show each channel 326 containing the same number of stabilizing ribs 324, more or less stabilizing ribs 324 may be present and in different quantities in each channel 326. Further, the stabilizing ribs 324 may not extend the whole length of the suction duct 300. Indeed, the stabilizing ribs 324 may be partial ribs, or castellated or serrated ribs and can be either linear as shown or non-linear. In other embodiments of the suction duct 300, the stabilizing ribs 324 may alternatively be in the form of an individual or series of pads or buttons. The stabilizing ribs 324 and any alternative structures discussed above are a stabilizing structure that extends radially from the body of the suction duct 300 to bear against the inner wall of the shell to prevent the suction duct 300 from deforming into or toward the shell.

As illustrated in FIG. 18, the stabilizing ribs 324 interact with the housing 12 to protect the annular integrity of the suction duct 300. The deformation process is most likely to affect the recessed wall sections because those sections are not in surface to surface contact with the generally cylindrical housing 12, unlike the peripheral wall sections 306*a*, 306*b*, 306*c* and 306*d*. Therefore, the stabilizing ribs are included to provide some contact surface between the recessed wall sections 322 and the housing 12 while still maintaining channels 326 to provide a lubricating oil return path back to the sump 76. Further, by protecting the annular integrity of the suction duct 300, deformation of the ring body 302 is prevented, and a seal between the top of ring body 302 and the stator 50 and a seal between the bottom of the ring body 302 and the lower bearing 44 is maintained.

Figure 19:
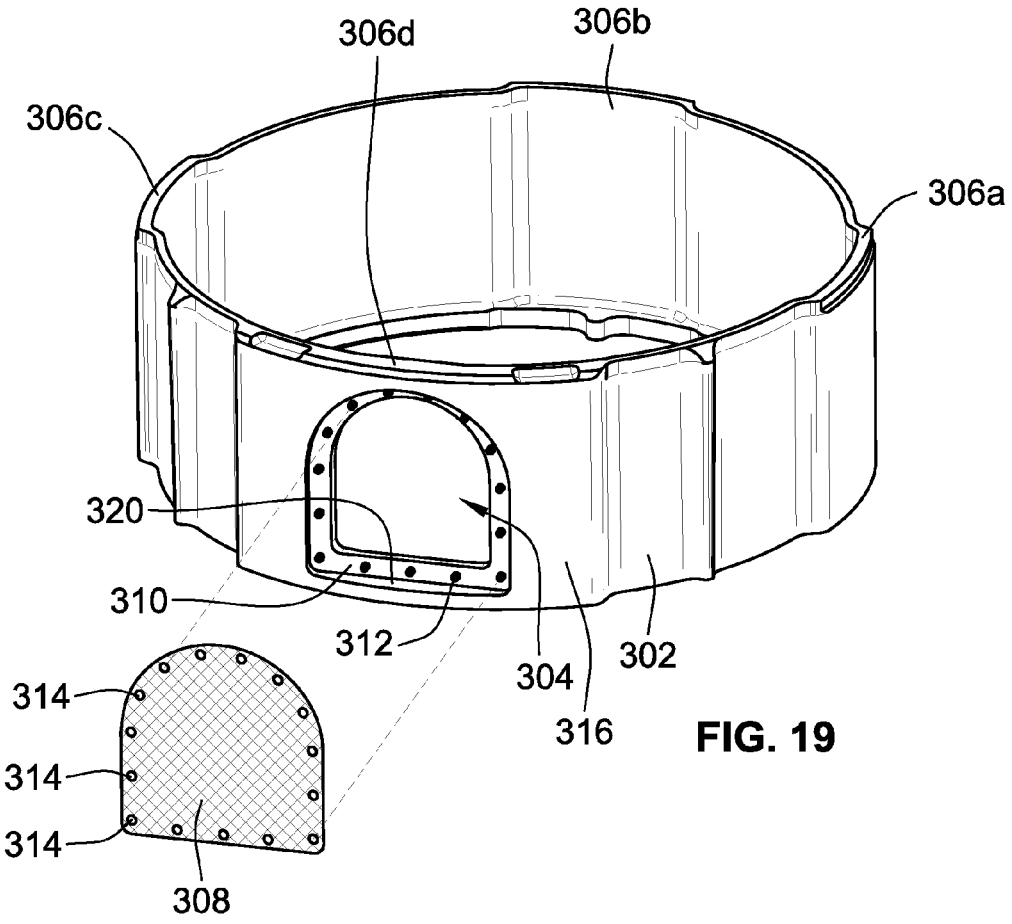
FIG. 19 is an exploded isometric assembly view of the suction duct body and screen prior to assembly, in accordance with a particular embodiment of the present invention.

As illustrated in FIG. 19, the suction duct 300 includes a screen 308 that is situated in the opening 304 to filter fluid entering through the inlet port 18. The screen 308 is installed and integrally bonded in a pocket 310. In the particular embodiment of the suction duct 300 illustrated in FIG. 19, the pocket 310 includes several posts 312 that mate with reciprocal holes 314 in the screen 308. During assembly, the screen 308 is inserted into the pocket 310 and the posts 312 are melted such that the melted posts 312 hold the screen 308 in place. The posts 312 may be made of a plastic material and may be heat staked by melting the plastic using a localized heat source or an ultrasonic horn.

Figure 20:
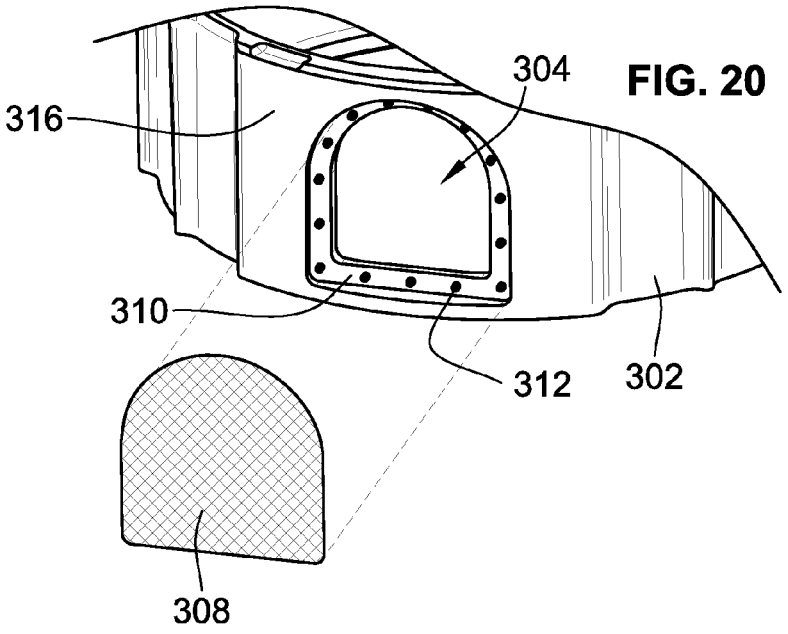
FIG. 20 is a view similar to FIG. 19, but according to an alternative embodiment of the present invention.

Another embodiment of the present invention where the screen 308 does not have the holes 314 is illustrated in FIG. 20. In this particular embodiment, the suction duct 300 includes pocket 310, which has a series of posts 312 around the periphery of opening 304. However, instead of having holes 314 that mate with the posts 312, the posts 312 merely protrude through the small pore openings already present in the screen 308. This may occur during the localized melting of the posts 312 during assembly. Similar to the embodiment shown in FIG. 19, the posts 312 are melted and the deformed plastic holds the screen 308 in place.

Figure 21:
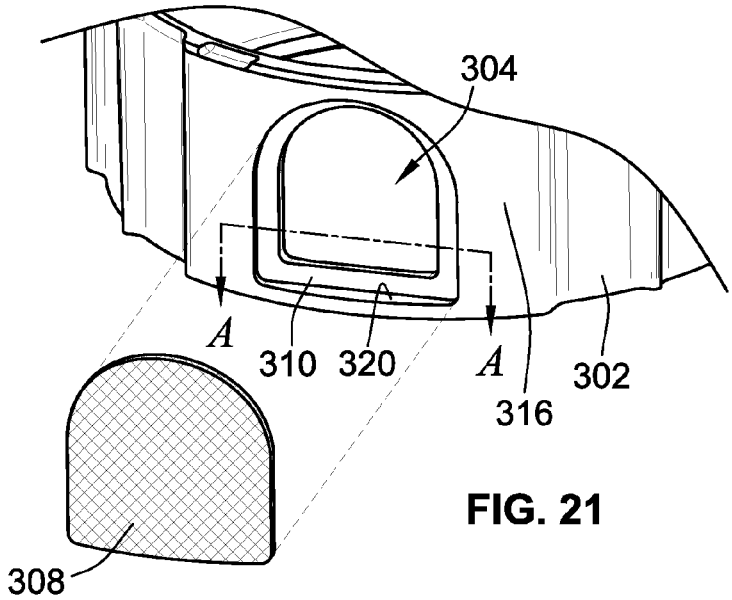
FIG. 21 is an exploded isometric assembly view of a suction duct, in accordance with another embodiment of the present invention.
Figure 22:
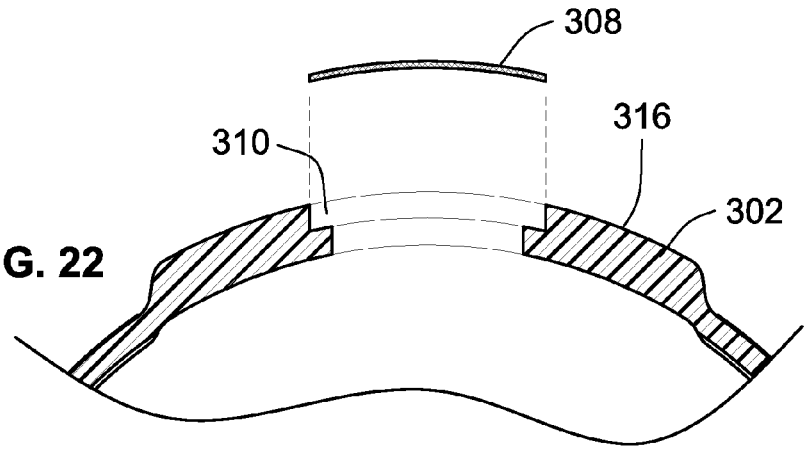
FIG. 22 is a cross section view of a suction duct with a pocket in accordance with the embodiment of FIG. 21.
Figure 23:
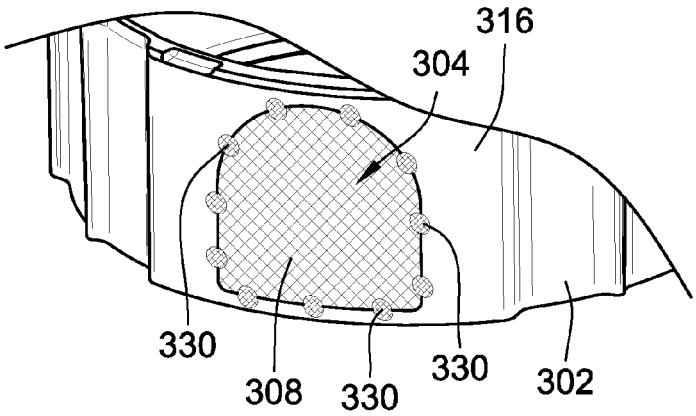
FIG. 23 is an assembled isometric view of the suction duct according to the embodiments of FIGS. 21 and 22.

FIG. 21 illustrates another embodiment of the present invention, where the pocket 310 does not include the posts 312. FIG. 22 shows a cross section of the suction duct 300 through the pocket 310. Screen 308 is merely placed into the pocket 310. In this particular embodiment of the invention, the suction duct 300 is made of any thermoplastic material. To hold the screen 308 in place, portions of the recessed ledge 320 are melted around the periphery of the opening 304 to adhere to the screen 308. FIG. 23 illustrates the melted portions 330 that hold the screen 308 in the pocket 310.

Figure 24:
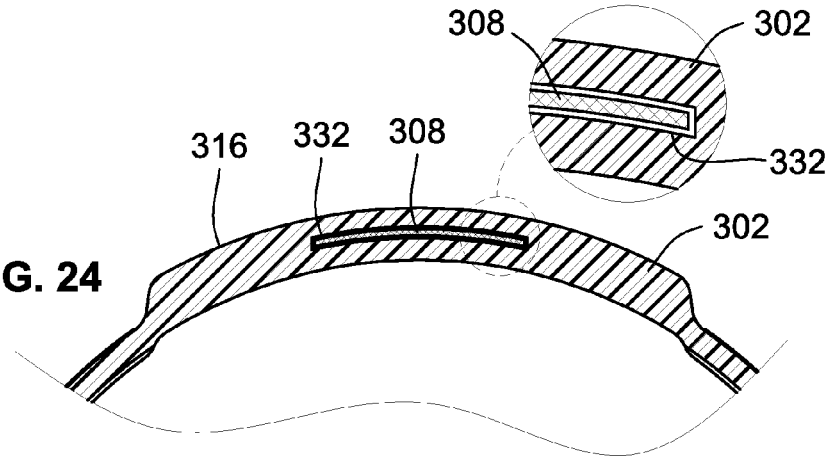
FIG. 24 is a cross section view of a suction duct with a slot for inserting a screen in accordance with yet another embodiment of the present invention.
Figure 25:
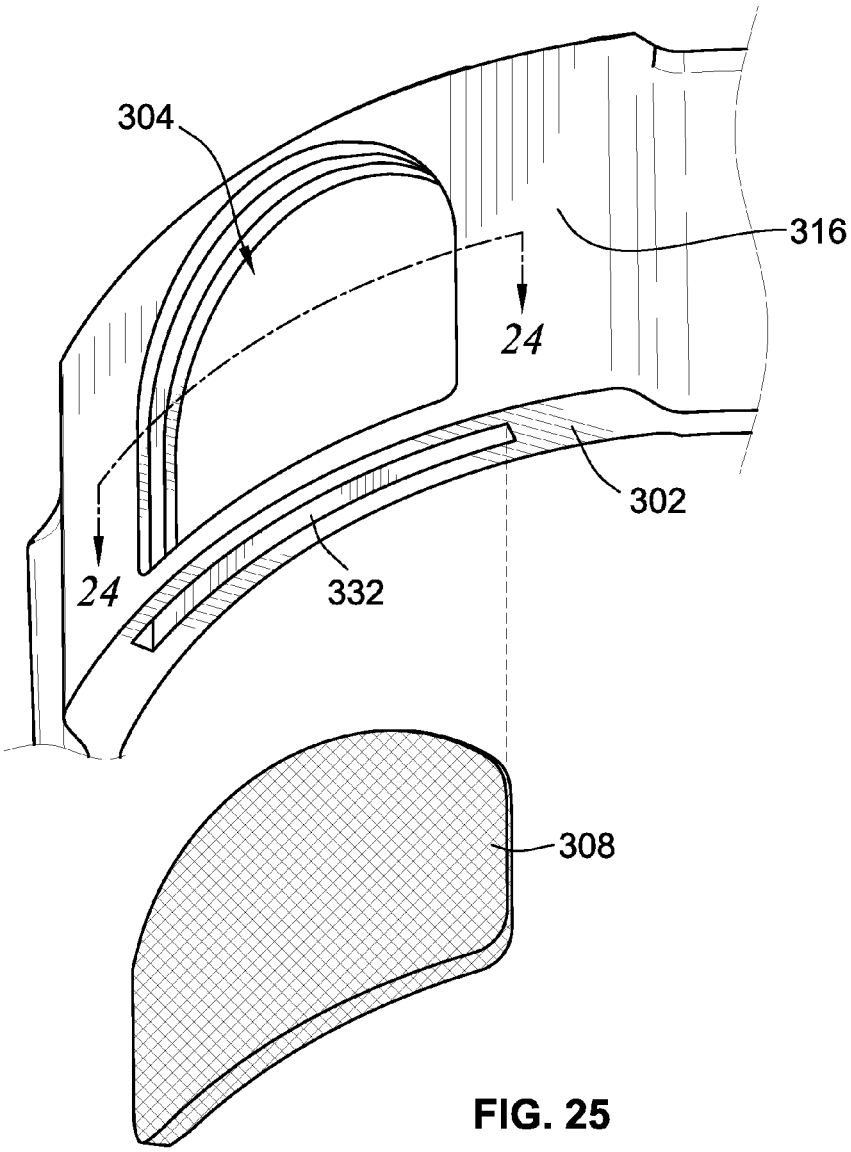
FIG. 25 is an isometric exploded assembly view of the suction duct embodiment of FIG. 24.

FIG. 24 illustrates yet another embodiment of the suction duct 300 that includes a slot 332 instead of the recessed ledge 320 from FIGS. 16-23. The slot 332 is an opening in either the bottom or top of the suction duct 300 that allows a screen 308 to be inserted into the slot 332 such that the screen 308 covers the opening 304. FIG. 25 illustrates a screen 308 that is inserted through a slot 332 in the bottom of the suction duct 300. In the particular embodiment illustrated in FIG. 25, the screen 308 is inserted into slot 332, and then a portion of the suction duct 300, which is made of any thermoplastic material, is melted such that it adheres to the screen 308 to hold the screen 308 in the slot 332.

In the above described embodiments of the suction duct 300, the screen 308 is attached to the suction duct 300 with enough strength such that the force caused by the refrigerant, as it is drawn into the inlet port 18 (see FIG. 15) under considerable velocity, does not dislodge the screen 308. Thereby, allowing the screen to filter debris from the refrigerant prior to entering the scroll compressor 14.

Additionally, the screen 308 can be made from a mesh of metal wire, while the suction duct 300 can be a molded plastic member such as nylon or other plastic material. The heat staking and thermal welding, discussed above, allows melting only of the plastic material of the suction duct 300 without damaging the metal screen 308. Further, the drive unit 16 (see FIG. 1) is typically an electric motor 40, which includes a stator 50. Whether the screen 308 is placed inside a pocket 310 (as in FIG. 19) or a slot 332 (as in FIG. 25), the screen 308 is electrically insulated from the stator 50 of the electric motor 40 by virtue of the plastic material in the ring body 302. The insulation effect is accomplished in the embodiment of the suction duct 300 that includes either the pocket 310 or the slot 332 because the screen is surrounded by the material of the suction duct 300, which generally is not electrically conductive. Typically, the suction duct 300 will be made of material that is generally electrically insulating, such as the preferred plastic material noted above.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A compressor for compressing a fluid, comprising:

a housing having an inlet for receiving the fluid and an outlet returning the fluid;

a compressor mechanism adapted to compress a fluid toward the outlet, the compressor mechanism housed in the housing;

a drive unit operatively connected to the compressor mechanism for driving the compression mechanism to compress fluid;

a suction duct in the housing having an inlet region arranged over the inlet of the housing;

a screen in the inlet region integrally bonded to the suction duct;

wherein the drive unit is an electrical motor and the suction duct comprises a ring body surrounding the electrical motor, wherein the ring body, surrounding the electrical motor, further comprises a window and a recessed ledge formed from a plastic material, the recessed ledge surrounding the window and facing the inlet and away from the electrical motor, and wherein the screen is positioned in the recessed window.

2. The compressor of claim 1, wherein the screen comprises a metal screen, the inlet region covering the stator, the metal screen being electrically isolated from stator by the plastic material.

3. The compressor of claim 1, wherein the housing includes a generally cylindrical shell surrounding the ring body, the ring body having an arcuate surface surrounding the window and the recessed ledge, the arcuate surface adapted to be in surface to surface contact with an inner surface of the generally cylindrical shell, wherein a flow path for fluid extends through the screen and into a region about the motor.

4. A compressor for compressing a fluid, comprising:

a housing having an inlet for receiving the fluid and an outlet returning the fluid;

a compressor mechanism adapted to compress a fluid toward the outlet, the compressor mechanism housed in the housing;

a drive unit operatively connected to the compressor mechanism for driving the compression mechanism to compress fluid;

a suction duct in the housing having an inlet region arranged over the inlet of the housing, the suction duct comprising a ring body that surrounds the drive unit;

a screen in the inlet region integrally bonded to the suction duct;

wherein the suction duct comprises plastic material, at least a portion of the plastic material being thermally deformed to integrally bond the screen to the suction duct; and wherein the suction duct comprises a ring body having a window and a recessed ledge and providing a pocket in the ring body, the recessed ledge surrounding the window, the screen situated along the recessed ledge.

5. The compressor of claim 4, wherein the screen is heat staked to the suction duct, the suction duct comprising a plurality of bosses extending through and thermally deformed to integrally bond the screen.

6. The compressor of claim 4, wherein portions of the ring body surrounding the window are thermally deformed over the screen and recess ledge.

7. The compressor of claim 4, further comprising a slot projecting axially through an end of the ring body and connecting to the window, the slot adapted to receive the screen therethrough to facilitate positioning of the screen in the pocket, further comprising an overhang formed into the ring body over the recessed ledge, at least a portion of the overhang thermally welded to secure the screen to the ring body.

8. A compressor for compressing a fluid, comprising:

a housing having an inlet for receiving the fluid and an outlet returning the fluid;

a compressor mechanism adapted to compress a fluid toward the outlet, the compressor mechanism housed in the housing;

a drive unit operatively connected to the compressor mechanism for driving the compression mechanism to compress fluid;

a suction duct in the housing having an inlet region arranged over the inlet of the housing, the suction duct comprising a ring body that surrounds the drive unit and a recessed window;

a screen in the inlet region integrally bonded to the suction duct and integrally bonded to the recessed window;

wherein the suction duct is seated on a peripheral groove of a lower bearing.

9. The compressor of claim 8, wherein the compressor mechanism is a scroll compressor comprising scroll compressor bodies having respective bases and respective scroll ribs that project from the respective bases and which mutually engage about an axis for compressing fluid; the motor operative to facilitate relative orbiting movement between the scroll compressor bodies, wherein the screen is secured by integrally bonding with enough retention force to counter the force of refrigerant flow through the inlet and through the suction duct and screen and eventually toward the scroll compressor bodies.

10. A method of securing a screen to a suction duct for use in a compressor, comprising:

providing a suction duct body having a window and a recessed ledge, the recessed ledge surrounding the window, the suction duct body comprising a ring body configured to surround a drive unit for the compressor;

situating a screen in the window and along the recessed ledge;

integrally bonding material of the suction duct body to the screen.

11. The method of claim 10, wherein the method comprises heat staking a plurality of bosses formed on the suction duct to thermally weld material of the suction duct body to the screen.

12. The method of claim 10, wherein integrally bonding material of the suction duct body to the screen comprises thermally welding material of the suction duct body to the screen.

13. The method of claim 12, wherein the screen is metal, further comprising electrically isolating the screen from a motor of the compressor that is in contact with the suction duct body with the plastic material of the suction duct body.

14. The method of claim 13, wherein the compressor is a scroll compressor having a housing with an inlet and the suction duct body comprises a ring shape, further comprising:

arranging the screen in a region over the inlet with inlet flow flowing through the suction duct body and toward the motor; and surrounding the motor with the suction duct body.

15. The method of claim 12, wherein the suction duct body comprises plastic material, and wherein thermally welding material of the suction duct body comprises melting material of the suction duct body.

* * * * *